US005747231A

United States Patent [19]

Sato et al.

[11] Patent Number: 5,747,231

[45] Date of Patent: May 5, 1998

[54] SILVER HALIDE PHOTOGRAPHIC MATERIAL

[75] Inventors: Takehiko Sato; Hiroo Takizawa; Osamu Takahashi, all of Kanagawa, Japan

[73] Assignee: Fuji Photo Film Co., Ltd., Kanagawa, Japan

[21] Appl. No.: 701,534

[22] Filed: Aug. 26, 1996

Related U.S. Application Data

[63] Continuation of Ser. No. 515,227, Aug. 15, 1995, abandoned.

[30] Foreign Application Priority Data

Aug. 17, 1994 [JP] Japan ..... 6-214330

[51] Int. Cl.[6] ..... G03C 1/053

[52] U.S. Cl. ..... 430/514; 430/535; 430/536; 430/537; 430/546; 430/609

[58] Field of Search ..... 430/537, 514, 430/536, 627, 609, 546, 535

[56] References Cited

U.S. PATENT DOCUMENTS

| | | | |
|---|---|---|---|
| 2,816,028 | 12/1957 | Miusk | 430/627 |
| 5,055,386 | 10/1991 | Hirano et al. | 430/545 |

FOREIGN PATENT DOCUMENTS

| | | |
|---|---|---|
| A-2-6942 | 1/1990 | Japan . |
| A-7-140616 | 6/1995 | Japan . |

*Primary Examiner*—Thorl Chea

*Attorney, Agent, or Firm*—Sughrue, Mion, Zinn, Macpeak & Seas, PLLC

[57] ABSTRACT

A silver halide photographic material is disclosed, comprising a support having thereon photographic constituent layers with at least one layer thereof containing water-insoluble polymers, wherein at least one of the water-insoluble polymers is a polymer containing an aromatic ring and having a number average molecular weight of 4,000 or less and the weight percentage of the aromatic ring in the polymer molecule is 40% or more.

11 Claims, No Drawings

SILVER HALIDE PHOTOGRAPHIC MATERIAL

This is continuation of application Ser. No. 08/515,227 filed Aug. 15, 1995, now abandoned.

FIELD OF THE INVENTION

The present invention relates to a silver halide photographic material, more specifically, to a silver halide photographic material which contains a fine emulsified dispersion having good emulsion dispersibility and excellent in storage stability and is restrained from peeling in layers upon contact or adhesion of an emulsion surface to other materials under high humidity. The present invention may be applicable both to a color photographic material and to a black-and-white photographic material but it is preferably applied to a color photographic material.

BACKGROUND OF THE INVENTION

In general, the color reproduction of a silver halide color photographic material is effected by the subtractive color process and here, silver halide emulsions each selectively sensitive to blue, green or red, and dye-forming coupler to form yellow, magenta or cyan dye each having a complementary relation to the above-described lights, respectively, are used.

With respect to a multi-layer color photographic material, a method commonly used for producing a multi-layer type silver halide color photographic material comprises incorporation of water-insoluble dye-forming couplers each in the form of a dispersion into an aqueous binder (particularly, gelatin) solution so as to fix yellow, magenta and cyan dye-forming couplers to separate layers, respectively.

In order to achieve higher color density, the grain size of the oil phase in the dispersion containing the water-insoluble dye-forming coupler is preferably as small as possible and it is very important that during storage of the dispersion, the oil phase grain does not bulk up or photographic raw materials such as the dye-forming coupler contained in the oil phase are not deposited. Accordingly, investigations have been hitherto made on fine emulsified dispersion having excellent storage stability.

An example of the method for producing a water dispersion of a water-insoluble coupler is a so-called oil protect method as described in U.S. Pat. No. 2,322,027 where a coupler is dissolved in an organic solvent having a high boiling point and emulsion-dispersed in an aqueous gelatin solution.

The coupler dispersed by a method using a high boiling point organic solvent undergoes little deposition as a crystal in the dispersion and a stable dispersion can be easily obtained. However, it is difficult to apply the method to couplers which are hard to dissolve in a high boiling point organic solvent and thus, couplers which can be used are restricted or in the case when a large amount of high boiling point organic solvent is used, the layer to which the solvent is added in a large amount is reduced in the physical strength and in order to compensate for the reduction, a large amount of gelatin is required. As a result, the thickness of photographic constituent layers increases to bring about another adverse effect such that an image obtained is low in sharpness.

Also, a problem is present such that since the hue of the colored dye changes depending upon the kind of a high boiling point organic solvent used, the kind of high boiling point organic solvent applicable as a coupler solvent is restricted. Many investigations have hitherto been made on the method for obtaining a fine emulsified dispersion excellent in storage stability without using a large amount of a high boiling point organic solvent and also on the silver halide color photographic material containing the fine emulsified dispersion.

As another means for obtaining a fine and stable emulsified dispersion using no or a restrained amount of a high boiling point organic solvent, U.S. Pat. No. 4,199,363 and West German Patent Application (OLS) Nos. 2,541,274 and 2,541,230 disclose methods where a dispersion is obtained by adding a water-miscible organic solvent solution of coupler to impregnate a polymer latex with the solution and then removing the water-miscible organic solvent. However, the method using a latex has a problem in that the coupler able to soak into the latex is restricted with respect to the amount as compared with the case where a water-immiscible high boiling point organic solvent is used and if the coupler is added in a large amount so as to obtain a maximum color density on a sufficient level, coagulation of couplers is caused.

Still another means for obtaining a fine and stable emulsified dispersion using no or a restrained amount of a high boiling point organic solvent is a method where fine dispersion is obtained by depositing couplers or other hydrophobic materials for photographic use from the solution state and this is well known in the photographic field. Representative examples thereof include a method where a coupler is formulated into an aqueous solution mixed with a basic substance and the coupler deposited resulting from lowering of pH in the presence of a surface active agent is obtained as a dispersion and a method where a deposited dispersion is obtained by using the change of the solvent composition, for example, a hydrophobic substance is dissolved in a water-miscible organic solvent and water is added thereto in the presence of a surface active agent to deposit the hydrophobic substance, and these methods are described in U.S. Pat. Nos. 2,870,012 and 4,388,403 and *Research Disclosure* (RD) No. 16468 (December, 1977). Also, European Patent 374837A2 discloses that an aqueous solution containing an anionic surface active agent and a nonionic polymer is mixed with a basic aqueous solution of coupler to effect neutralization to thereby obtain a stable and fine coupler dispersion.

However, even by these methods, depending upon couplers, the grain size of the resulting dispersion bulks up and coagulation may be caused by aging, thus a method for emulsion-dispersion favored with further good dispersibility and stability has been desired.

As a good means for providing dispersibility and emulsifiability, U.S. Pat. No. 5,055,386 discloses a method for obtaining a fine emulsified dispersion having good emulsification stability where an oil-soluble polymer containing from 30 to 70% of a component having a molecular weight of 40,000 or less is emulsion-dispersed in combination with an oil-soluble coupler and the use amount of a high boiling point organic solvent is restrained.

However, according to the investigation by the present inventors, the method disclosed in European Patent 374837A2 raises a new problem such that depending upon the kind of the photographic oil-soluble component used for the co-emulsification, the photographic oil-soluble component in the emulsified dispersion may be deposited during storage at low temperatures to generate a coarse grain or the multi-layer type color photographic material using the emulsified dispersion may undergo peeling in layers under high humidity conditions when the surface of the emulsion layer contacts with a surface of other materials, giving rise to deterioration in physical properties of the layer to cause separation between layers.

It has been demanded to enhance the emulsion-dispersibility and further improve the deposition prevention during the storage of the dispersion without causing any deterioration in physical properties of layers described above.

On the other hand, not only the dye-forming coupler, but also various additives, such as color mixing inhibitors, dye image stabilizers or ultraviolet absorbents, are frequently used in respective photographic constituent layers required so as to further improve the image quality or to improve fastness of the image and hence, an emulsion-dispersion means capable of providing good dispersibility and stability for an emulsified dispersion containing various materials for photographic use has been demanded.

SUMMARY OF THE INVENTION

An object of the present invention is to provide a silver halide photographic material containing a fine emulsified dispersion, which has good dispersibility, contains little coarse grains and is excellent in storage stability, of photographic raw materials and restrained from peeling in layers on contact or adhesion of an emulsion surface to a surface of other materials under high humidity.

DETAILED DESCRIPTION OF THE INVENTION

The object of the present invention can be achieved by:

(1) a silver halide photographic material comprising a support having thereon photographic constituent layers with at least one layer thereof containing water-insoluble polymers, wherein at least one of the water-insoluble polymers is a polymer containing an aromatic ring and having a number average molecular weight of 4,000 or less and the weight percentage of the aromatic ring in the polymer molecule is 40% or more;

(2) a silver halide photographic material as described in item (1) above, wherein the water-insoluble polymer having a number average molecular weight of 4,000 or less is a homopolymer or a copolymer derived from at least one of styrene, α-methylstyrene, β-methylstyrene and a monomer unit having a substituent on the benzene ring of these monomers; and (3) a silver halide photographic material as described in item (1) above, wherein the weight percentage of the aromatic ring in the molecule of the water-insoluble polymer having a number average molecular weight of 4,000 or less is 55% or more.

The present invention will be described below in detail.

The above-described water-insoluble polymer is a polymer containing as a constituent factor a monomer unit having at least one aromatic group and being substantially insoluble in water. The monomer is preferably a vinyl monomer.

In order to exert the effect of the present invention, the average molecular weight of the water-insoluble polymer may be 4,000 or less, but it is preferably 2,000 or less, more preferably 1,500 or less. In view of causing no impairment in emulsifiability or color forming property when a color forming coupler is contained and also in view of physical properties of the layer, the number average molecular weight is most preferably from 400 to 1,000. The polymer of the present invention may consist of one kind of monomers, e.g., a so-called homopolymer, or may be a copolymer comprising two or more kinds of monomers.

The "water insolubility" as used in the present invention means that the solubility in water is 0.1% or less. The water-insoluble polymer of the present invention contains an aromatic ring in its molecule at a weight percentage of 40% or more, preferably 50% or more and more preferably 55% or more. Also, in the present invention, in view of compatibility with photographic additives, the weight percentage of the aromatic ring in the molecule of the water-insoluble polymer is preferably 60% or less. Further, in view of dispersion stability and physical properties of the layer, the aromatic ring is preferably contained in the molecule of the polymer of the present invention at a weight percentage of 40% or more. Thus, the weight percentage of the aromatic ring in the molecule of the water-insoluble polymer is generally 40 to 90%, preferably 50 to 80%, and more preferably 55 to 60%.

The aromatic ring as used herein means a skeleton of a benzene ring, a naphthalene ring, an anthrathene ring, an indene ring or an aromatic heterocyclic ring and the aromatic heterocyclic ring includes a pyridine ring, a pyridazine ring, a pyrimidine ring, a pyrazine ring, a quinoline ring, an isoquinoline ring, a fran ring, a pyrrole ring, a thiophene ring and an azole ring. The aromatic ring may be further substituted by a substituent. The substituent which may be substituted on the aromatic ring includes an alkyl group, an aryl group, a heterocyclic group having N, O or S as a hetero atom, an alkoxy group, an aryloxy group, a halogen atom, a sulfonamido group, a carbonamido group, an alkoxycarbonyl group, an aryloxy group, a sulfamoyl group, and a carbamoyl group.

The weight percentage of the aromatic ring in the water-insoluble polymer of the present invention is calculated based on the structural formula of the polymer. More specifically, it is calculated by obtaining the percentage of the total atomic weight of the carbon atom and the hetero atom constituting all aromatic rings present in the structural formula to the total atomic weight of all atoms in the structural formula.

As long as the above-described condition is satisfied, the polymer of the present invention may be either a homopolymer or a copolymer. Although the structure thereof is not particularly restricted, preferred is a structure of a polymer derived from at least one of styrene, α-methylstyrene, β-methylstyrene and a monomer having a substituent on the benzene ring of these monomers. Examples of the substituent on the benzene ring of the monomers are the same as that previously disclosed in the examples of the substituent on the aromatic ring.

The comonomer copolymerized with styrene, α-methylstyrene, β-methylstyrene or a monomer having a substituent on the benzene ring of the monomer preferably includes a vinyl monomer or an olefin monomers for example, acrylic acid, acrylate, methacrylic acid, methacrylate, acrylamide, methacrylamide, vinylalcohol, vinylacetate, ethylene, propylene, butylene and halide thereof. The used amount of the comonomer is determined based on an amount (weight %) of the aromatic ring in the polymer.

Among these, preferred in view of color forming properties when a color-forming coupler is contained are a homopolymer and a copolymer derived from styrene, α-methylstyrene or β-methylstyrene.

The water-insoluble polymer of the present invention is also preferably substituted by a halogen atom such as fluorine, chlorine or bromine.

Most of water-insoluble, organic solvent-soluble polymers used in the present invention are available on the market and polymers other than those can be easily synthesized according to the synthesis method described, for example, in *4th Edition, Jikken Kagaku Koza* 28, *Kobunshi Gosei* (*Polymer Synthesis*).

Specific examples of the water-insoluble polymer of the present invention are set forth below but the present invention is of course not restricted to these compounds.

P-1

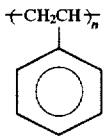

P-2

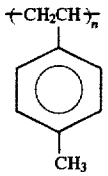

P-3

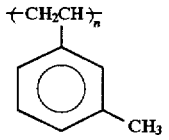

P-4

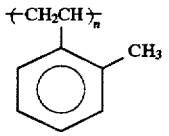

P-5

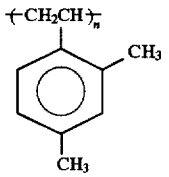

P-6

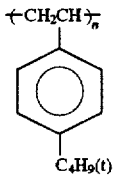

-continued

P-7

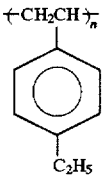

P-8

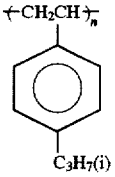

P-9

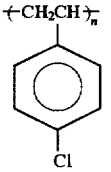

P-10

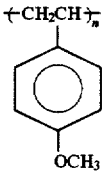

P-11

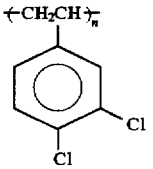

P-12

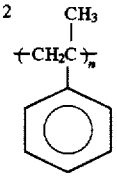

P-13

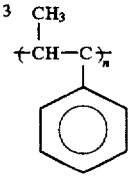

-continued
P-14
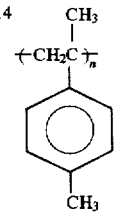
P-15
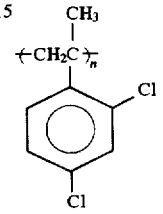
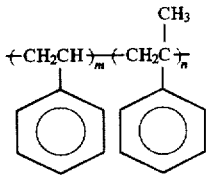
P-16 m/n = 10/90
P-17 m/n = 20/80
P-18 m/n = 50/50
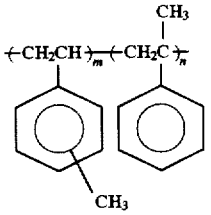
P-19 m/n = 10/90
P-20 m/n = 50/50
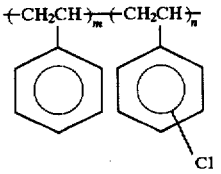
P-21 m/n = 10/90
P-22 m/n = 50/50
P-23
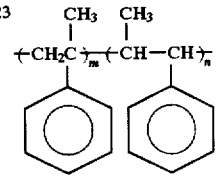
m/n = 50/50
P-24
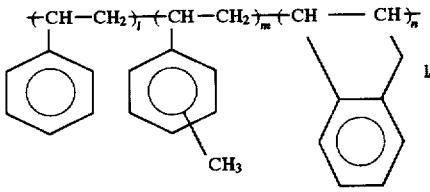
l/m/n = 30/40/30
-continued
P-25
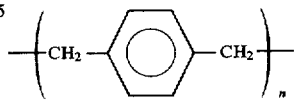
P-26
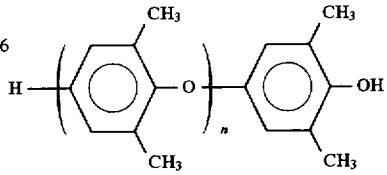
P-27
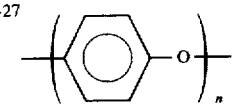
P-28
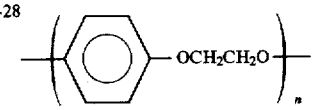
P-29
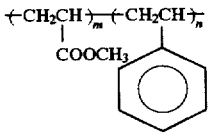
m/n = 10/90
P-30
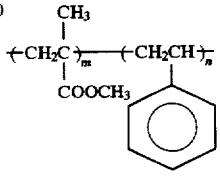
m/n = 10/90
P-31
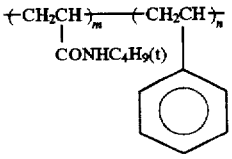
m/n = 5/95
P-32
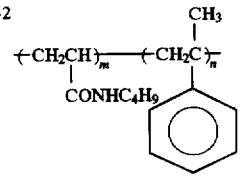
m/n = 5/95
P-33
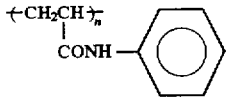

-continued

P-34

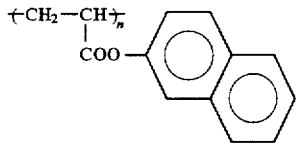

P-35

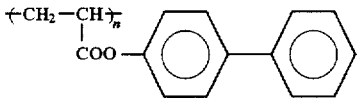

The water-insoluble polymer of the present invention is preferably emulsion-dispersed after it is dissolved together with photographic additives such as a coupler.

The water-insoluble polymer of the present invention is preferably used in an amount of from 0.01 to 0.7 parts by weight of the lipophilic components contained in the layer to which the polymer is added, such as a high boiling organic solvent, coupler, UV-absorbent, color fading inhibitor, color mixing inhibitor. If the use amount is less than the above-described range, no effect is provided on the improvement of storability of the emulsified dispersion, whereas if it exceeds the above-described range, the layer to which the polymer is added declines in its original functions such as color forming property. Also, if the use amount is less than 0.01 parts by weight, no effect is obtained on the improvement of the physical properties of the layer, whereas if it exceeds 0.7 parts by weight, the color forming property is deteriorated or the UV-cut ability decreases. The use amount is more preferably from 0.02 to 0.5 parts by weight, still more preferably from 0.05 to 0.3 parts by weight.

The photographic additive subjected to emulsion-dispersion together with the water-insoluble polymer of the present invention may be any of a coupler, an ultraviolet absorbent, a color mixing inhibitor, a discoloration inhibitor and a high boiling point organic solvent and can be selected from those described, for example, in JP-A-62-215272, JP-A-2-33144 and European Patent 0355660A2.

Specific examples thereof are set forth below but the present invention is by no means limited to these compounds.

Y-1

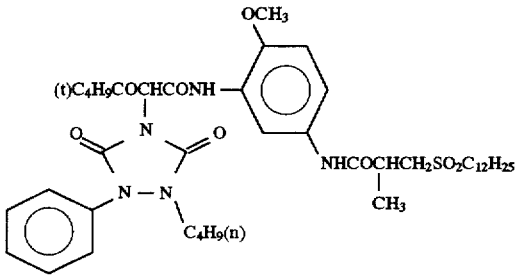

Y-2

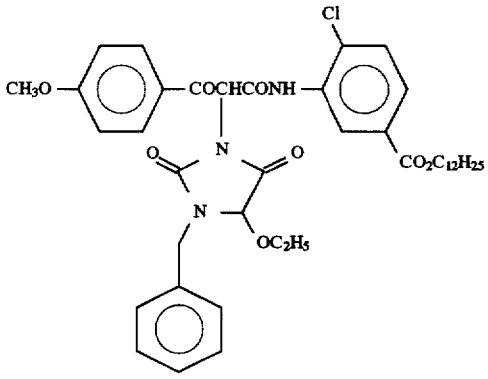

Y-3

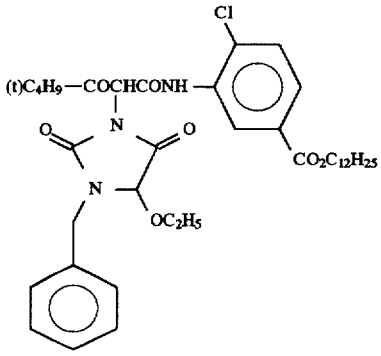

-continued
Y-4
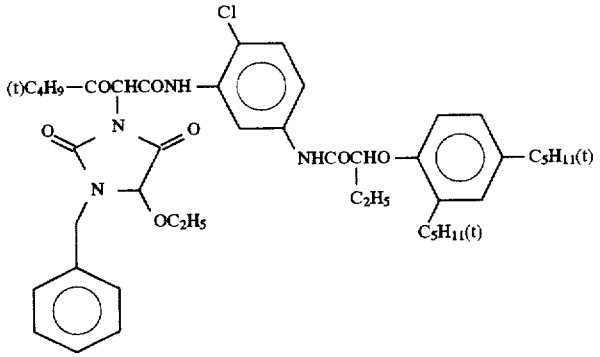
Y-5
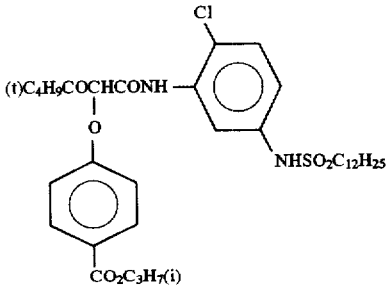
Y-6
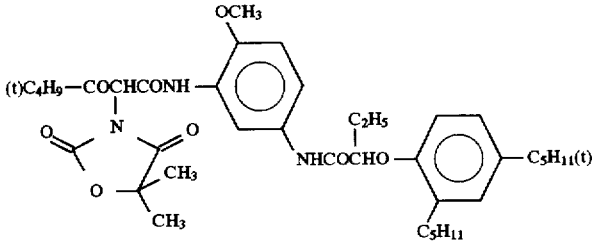
Y-7
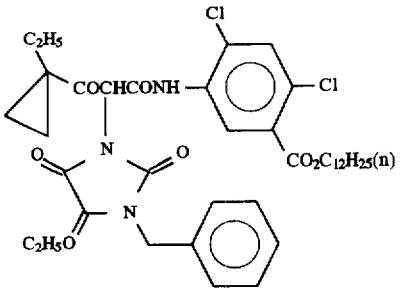
Y-8
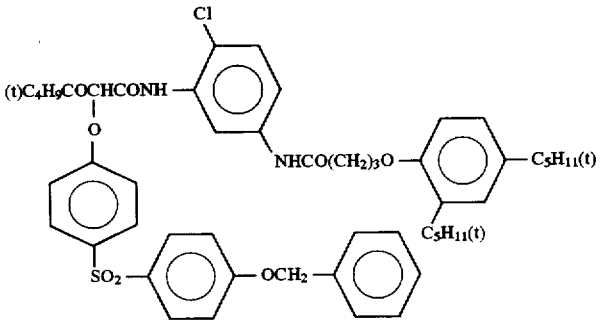

-continued
Y-9
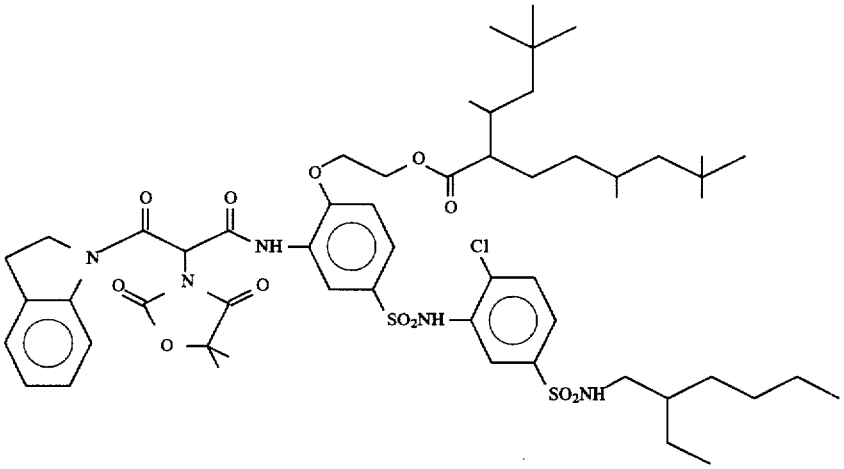
Y-10
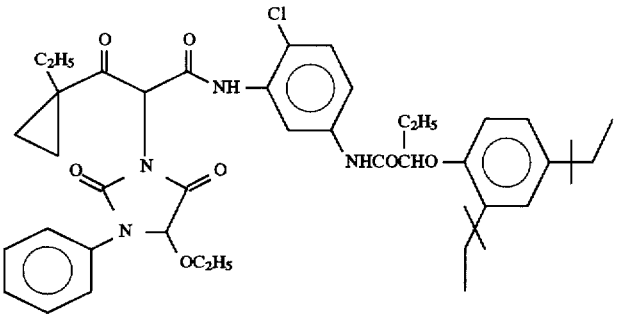
Y-11
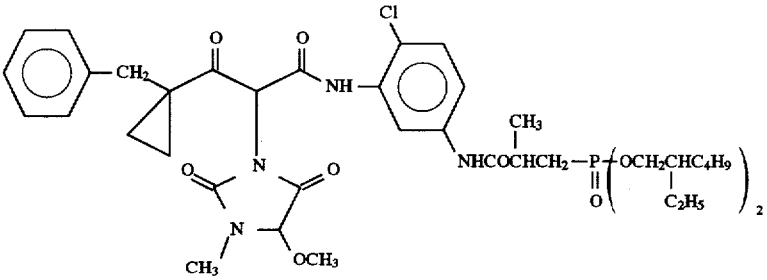
Y-12
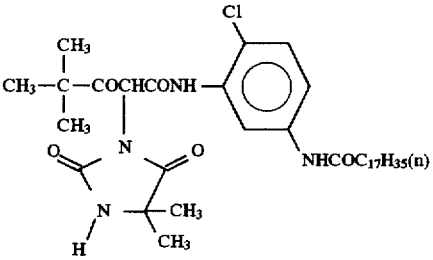

-continued
Y-13
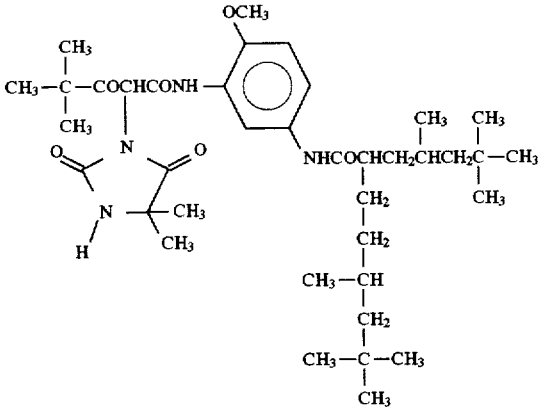
M-1
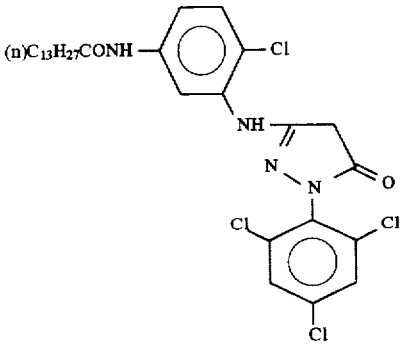
M-2
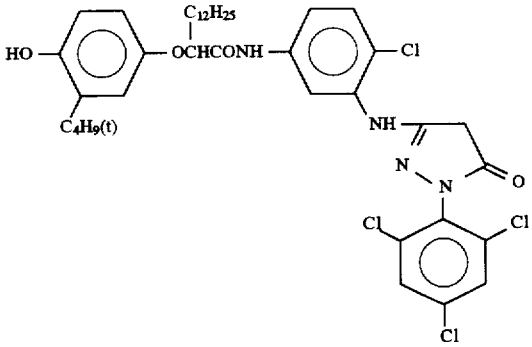
M-3
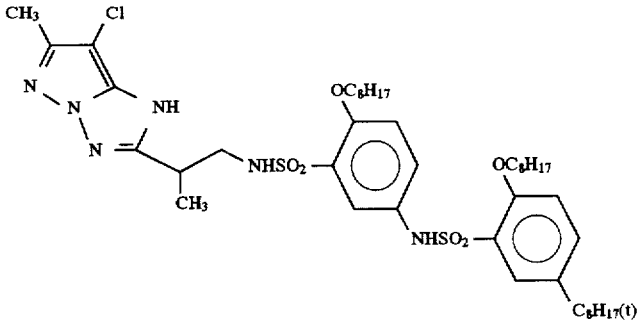

-continued
M-4
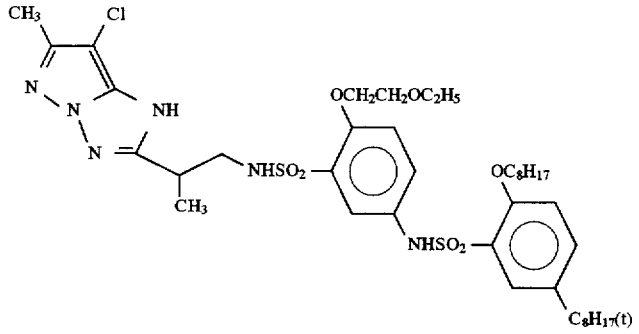
M-5
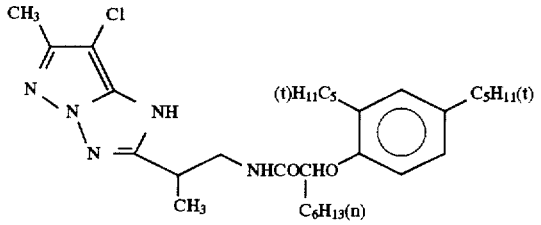
M-6
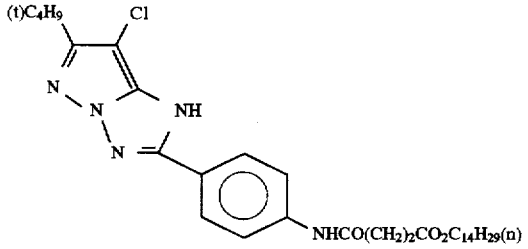
M-7
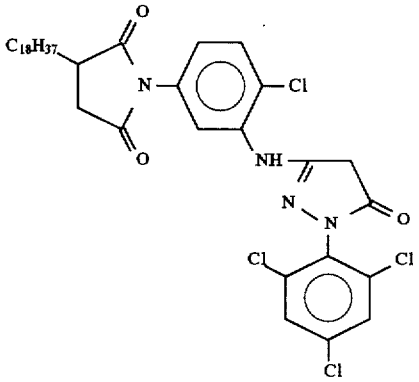
M-8
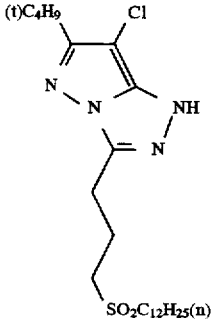

-continued
M-9
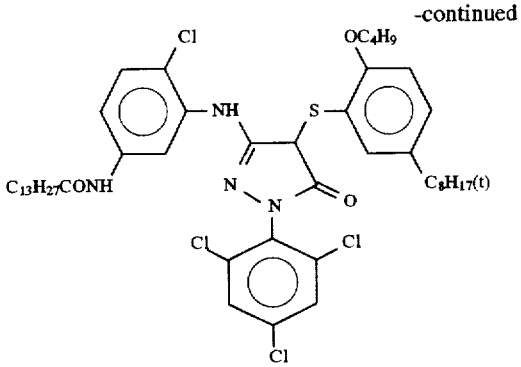
M-10
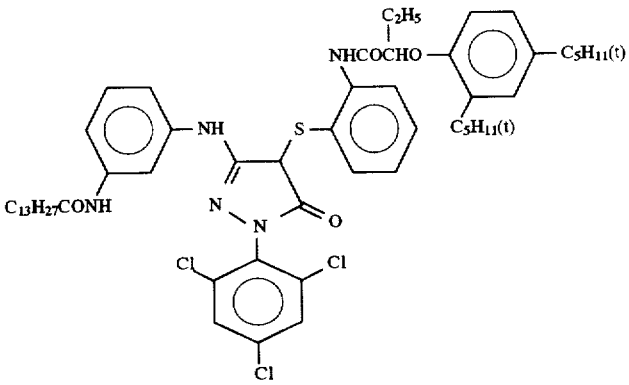
C-1
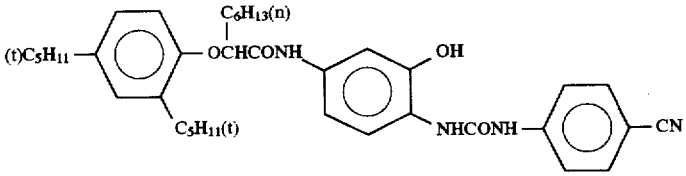
C-2
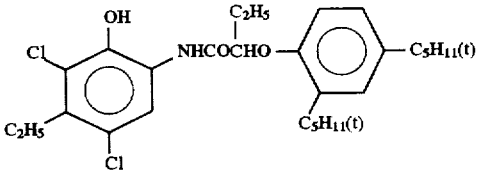
C-3
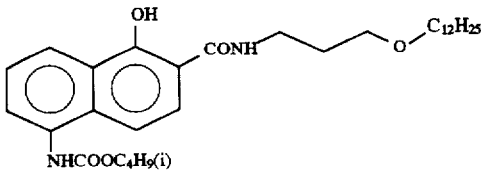
C-4
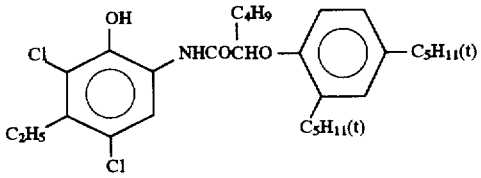
C-5
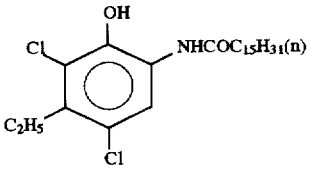

-continued
C-6
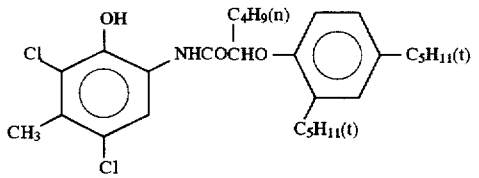
C-7
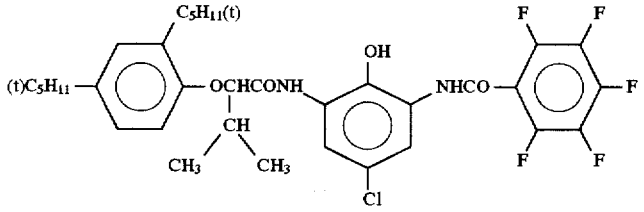
C-8
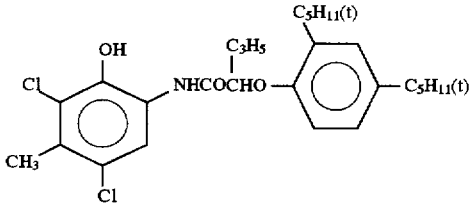
C-9
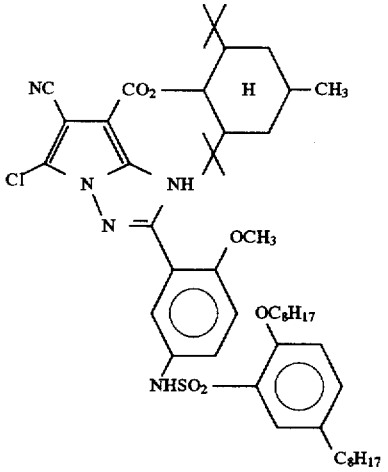
C-10
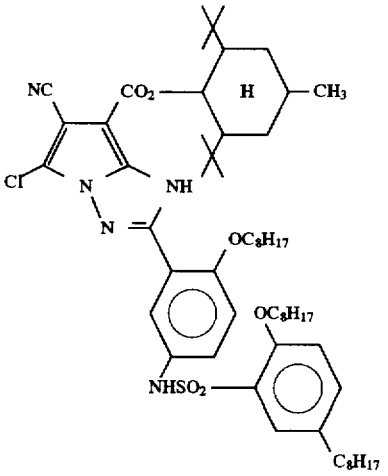

-continued

C-11

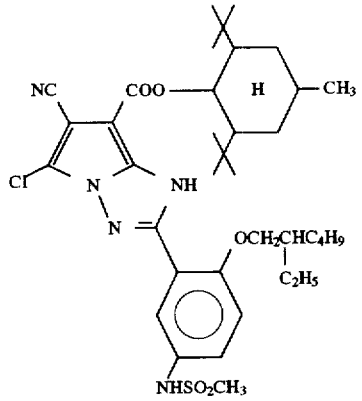

| No. | Rc | Ra | Rb |
|---|---|---|---|
| | 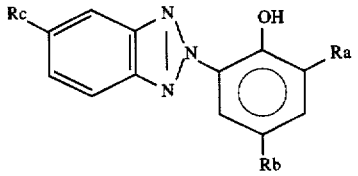 | | |
| I-1 | H | H | $-C_4H_9(t)$ |
| I-2 | H | H | $-C_{12}H_{25}(n)$ |
| I-3 | H | H | $-CH_2CH_2COOC_8H_{17}$ |
| I-4 | Cl | H | $-C_8H_{17}(t)$ |
| I-5 | Cl | H | $-CH_2CH_7COOC_8H_{17}$ |
| I-6 | H | $-C_4H_9(sec)$ | $-C_4H_9(t)$ |
| I-7 | H | $-C_5H_{11}(t)$ | $-C_5H_{11}(t)$ |
| I-8 | H | $-C_4H_9(t)$ | $-CH_2CH_2COOC_8H_{17}$ |
| I-9 | H | $-CH_3$ | $-C_4H_9(t)$ |
| I-10 | Cl | $-C_4H_9(t)$ | $-C_4H_9(t)$ |
| I-11 | Cl | $-C_4H_9(sec)$ | $-C_4H_9(t)$ |
| I-12 | Cl | $-C_4H_9(t)$ | $-CH_2CH_2COOC_8H_{17}$ |
| I-13 | $-OCH_3$ | $-C_4H_9(sec)$ | $-C_4H_9(t)$ |
| I-14 | $-C_4H_9(sec)$ | $-C_4H_9(t)$ | $-CH_2CH_2COOC_8H_{17}$ |
| I-15 | $-C_6H_5$ | $-C_5H_{11}(t)$ | $-C_5H_{11}(t)$ |
| I-16 | H | $-C_{12}H_{25}(n)$ | $-CH_3$ |
| | 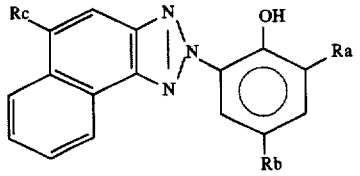 | | |
| I-17 | H | $-C_4H_9(t)$ | $-C_4H_9(t)$ |
| I-18 | H | H | $-CH_2CH_2COOC_8H_{17}$ |
| I-19 | $-OCH_3$ | $-C_{12}H_{25}(n)$ | $-CH_3$ |
| I-20 | Cl | $-C_4H_9(t)$ | $-CH_2CH_2COOC_8H_{17}$ |

| No. | $X_3$ | Ra | Rb | n-(OH) |
|---|---|---|---|---|
| | 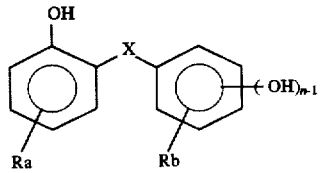 | | | |
| II-1 | $-CO-$ | $5-OC_4H_9$ | H | 1 |
| II-2 | " | $5-OC_8H_{17}$ | H | 1 |
| II-3 | " | $5-OC_{16}H_{33}$ | H | 1 |
| II-4 | " | $5-OC_{18}H_{37}$ | H | 1 |
| II-5 | " | $4-OC_4H_9$ | $4'-CH_3$ | 3 2'-,5'- |
| II-6 | " | $5-OCH_3$ | $3'-C_8H_{17}$ | 3 2'-,6'- |

-continued
| | | | | |
|---|---|---|---|---|
| II-7 | " | 5-$C_{12}H_{25}$ | 4'-$COCH_3$ | 2 2'-, |
| II-8 | " | 5-$COCH_3$ | 3'-$C_8H_{17}$ | 3 2'-,6'- |
| II-9 | " | 4-$OC_{12}H_{25}$ | 4'-$OCH_2C_6H_4-(p)CH_3$ | 2 2'- |
| II-10 | " | 5-$C_8H_{17}$ | 4'-$COC_6H_4-(p)CH_3$ | 3 2'-,6'- |
| 11-11 | $-COO-$ | 4-$C_{12}H_{25}$ | 4'-$C_4H_9(t)$ | 1 |
| II-12 | " | H | 4'-$C_4H_9(t)$ | 1 |
| II-13 | " | 4-$OC_{12}H_{25}$ | 5'-$OCH_3$ | 2 2'- |
| II-14 | " | 3-$OCH_3$ | 5'-$OC_{12}H_{25}$ | 2 2'- |
III-1
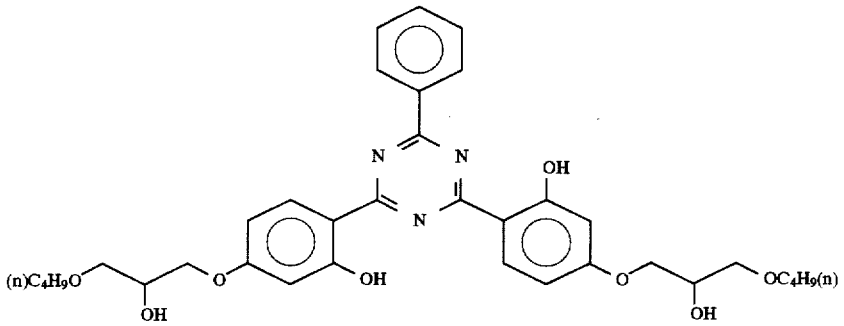
III-2
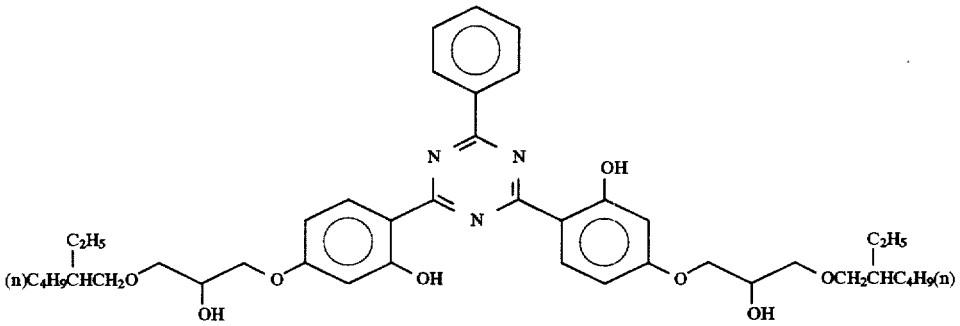
III-3
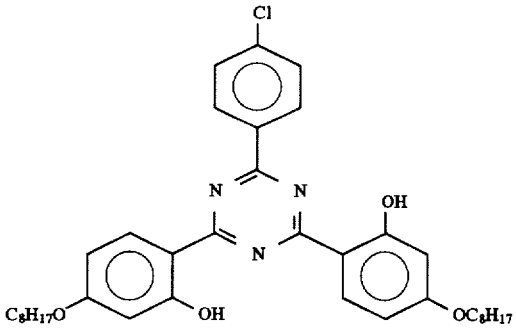
III-4
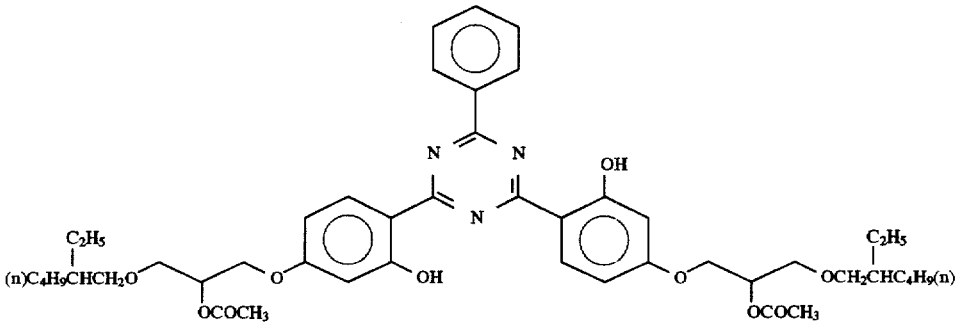

-continued
III-5
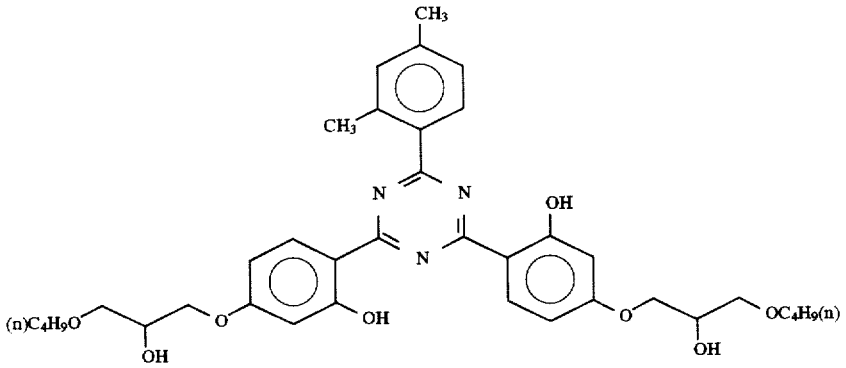
III-6
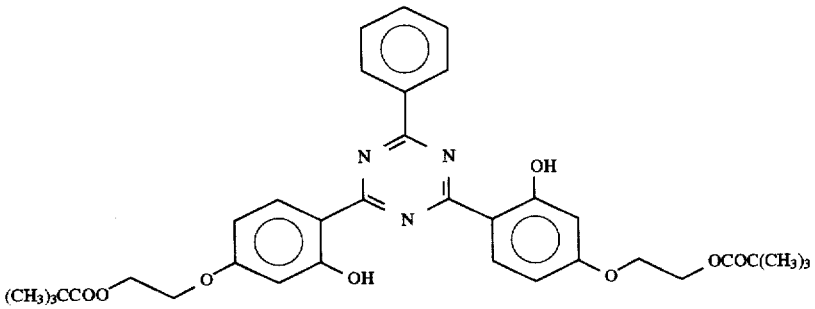
III-7
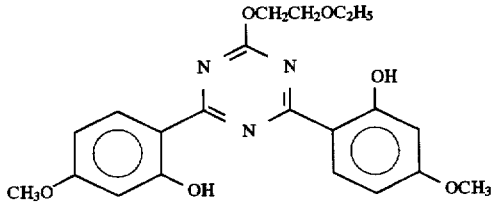
III-8
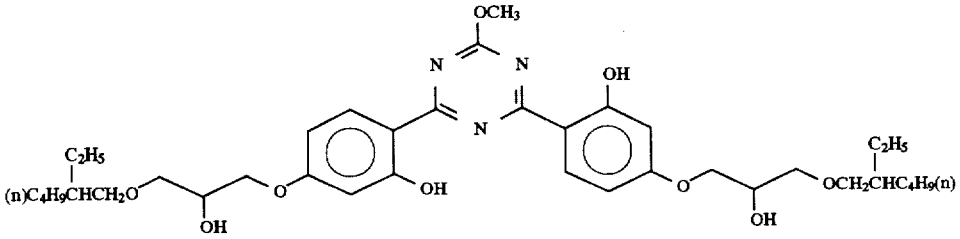
III-9
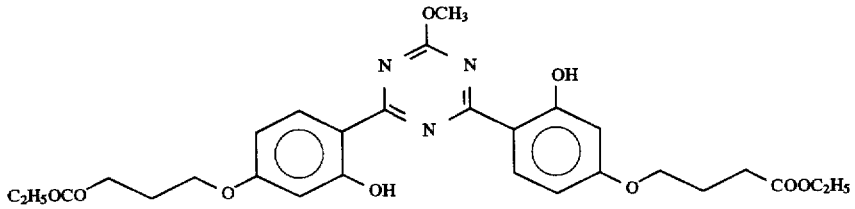

-continued

III-10

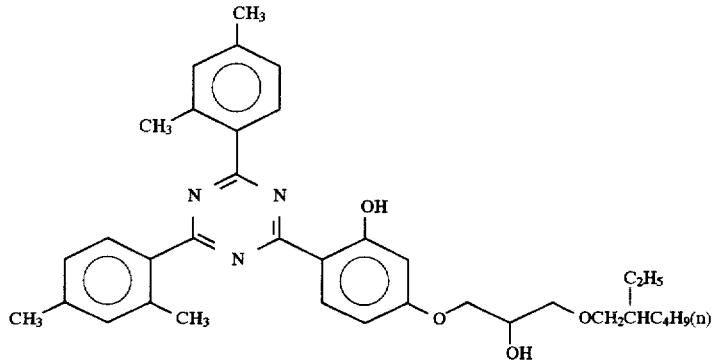

III-11

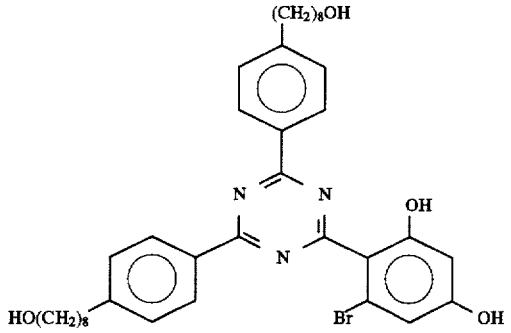

III-12

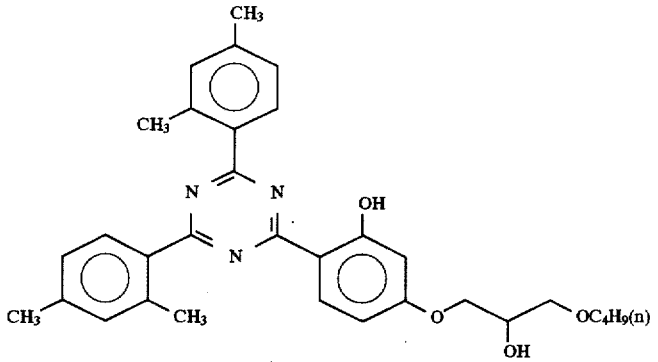

The water-insoluble polymer of the present invention is incorporated into at least one layer of the photographic constituent layers, preferably into a coupler-containing layer or an UV absorbent-containing layer.

In the present invention, the above-described water-insoluble polymer is usually incorporated into a photographic constituent layer (a hydrophilic colloid layer) by a known oil-in-water dispersion method as an oil protect method. More specifically, the water-insoluble polymer of the present invention is dissolved in a high boiling point organic solvent and a low boiling point auxiliary solvent, if desired, together with a photographic organic material which may be freely selected and then dispersed in an aqueous gelatin solution containing a surface active agent. Alternatively, the above-described polymer solution containing a surface active agent is mixed with water or an aqueous gelatin solution and through phase inversion, converted into an oil-in-water dispersion. The resulting dispersion may also be preferably subjected to distillation, noodle washing or ultrafiltration so as to remove the low boiling point organic solvent.

The above-described low boiling point auxiliary solvent used for dissolving the water-insoluble polymer is preferably an ester such as ethyl acetate or a ketone such as acetone.

The color photographic material of the present invention is constituted by coating at least one yellow color-forming silver halide emulsion layer, at least one magenta color-forming silver halide emulsion layer and at least one cyan color-forming silver halide emulsion layer on a support. The normal color printing paper contains color couplers each forming a dye having a complementary relation to the light to which one of the silver halide emulsions is sensitive to effect color reproduction by the subtractive color process. In the case of a normal color printing paper, the silver halide emulsion grains may be subjected to spectral sensitization in the order of the above-described color-forming layers with blue-sensitive, green-sensitive and red-sensitive spectral sensitizing dyes, respectively, and the color-forming layers may be provided on the support in the above-described order (namely, in the order of a yellow color-forming layer, a magenta color-forming layer and a cyan color-forming layer). However, the order may be changed. That is, in some cases, a light-sensitive layer containing a silver halide grain having the greatest average grain size is preferably provided as the uppermost layer in view of a rapid processing or in some cases, the magenta color-forming light-sensitive layer is preferably provided as the lowermost layer in view of storability under the light irradiation.

The light-sensitive layers and the colored-hues may not be in the above-described correspondence or at least one infrared-sensitive silver halide emulsion layer may be provided.

The support used in the present invention may be either a transmission type support or a reflection type support as long as it is a support on which photographic emulsion layers can be coated, such as glass, paper or plastic film.

The term "transmission type support" as used in the present invention means a support allowing viewing of a dye image formed on the silver halide emulsion layer through the transmitted light and examples thereof include a glass plate, a polyester film such as polyethylene terephthalate, cellulose triacetate and cellulose nitrate, a polyamide film, a polycarbonate film, a polystyrene film and a vinyl chloride resin.

The term "reflection type support" as used in the present invention means a support having a high reflectivity to make the dye image formed on the silver halide emulsion layer sharp and the reflection type support includes a support having coated thereon a hydrophobic resin dispersedly containing a light reflective substance such as titanium oxide, zinc oxide, calcium carbonate or calcium sulfate and a support formed of a hydrophobic resin itself dispersedly containing the light-reflective substance. Examples thereof include a polyethylene-coated paper, a polyester (e.g., polyethylene terephthalate), coated paper, a polypropylene synthetic paper and a transparent support having provided thereon a reflection layer or incorporated therein a reflective substance, such as a glass plate, a polyester film such as polyethylene terephthalate, cellulose triacetate and cellulose nitrate, a polyamide film, a polycarbonate film, a polystyrene film and a vinyl chloride resin.

The reflection type support used in the present invention is a paper support with each side being covered by a water-resistant resin layer and at least one water-resistant resin layer preferably contains white pigment particles. The white pigment particle is contained at a density of preferably 12 wt% or more, more preferably 14 wt% or more. The light-reflective white pigment particle is preferably prepared by thoroughly kneading a white pigment in the presence of a surface active agent and the surface of the pigment particle is preferably treated with a di-, tri- or tetra-hydric alcohol.

The white pigment fine particles are preferably uniformly dispersed in the reflection layer without causing agglomeration of particles and the distribution size can be obtained by determining the occupation area ratio (%) (Ri) of fine particles projected on the unit area. The coefficient of fluctuation of the occupation area ratio (%) can be obtained from the ratio s/R where s is the standard deviation of Ri and R is the average value of Ri. In the present invention, the pigment fine particle has a coefficient of fluctuation of the occupation area ratio (%) of 0.15 or less, preferably 0.12 or less, more preferably 0.08 or less.

In the present invention, a support having a surface of the second-class diffuse reflectivity may be used. The second-class diffuse reflectivity means the diffuse reflectivity obtained when the specular surface is made uneven to have finely divided specular faces directed toward different directions and the directions of finely divided surface (specular faces) are decentralized. The unevenness on the surface of the second-class diffuse reflectivity is preferably provided such that the three-dimensional average height to the center plane is from 0.1 to 2 μm, preferably from 0.1 to 1.2 μm and the frequency of unevenness on the surface with respect to the unevenness having a height of 0.1 μm or more is preferably from 0.1 to 2,000 cycles/mm, more preferably from 50 to 600 cycles/mm. JP-A-2-239244 describes such a support in detail.

The silver halide grain used in the present invention is preferably a silver chlorobromide, silver chloroiodobromide or silver chloride grain each having a silver chloride content of 95 mole % or more. In order to expedite the development processing time, grains consisting of silver chlorobromide or silver chloride and substantially free of silver iodide are preferably used in the present invention. The "substantially free of silver iodide" as used herein means that the silver iodide content is 1 mole % or less, preferably 0.2 mole % or less. On the other hand, for the purposes of raising a high illumination sensitivity, enhancing a spectral sensitization sensitivity, or increasing aging stability of the light-sensitive material, high silver chloride grains having a silver iodide content of from 0.01 to 3 mole % may be used in the emulsion surface in some cases as described in JP-A-3-84545. The halide composition of the emulsion may be different or the same among grains but if an emulsion comprising grains having the same halide composition is used, it is easy to homogenize the properties of grains. Also, with respect to the halide composition distribution inside of the silver halide emulsion grain, the grain may have a so-called uniform-type structure where any portion of the silver halide grain has the same composition, the grain may have a so-called laminate-type structure where the halide composition is different between the core inside the silver halide grain and the shell (single layer or a plurality of layers) surrounding the core, or the grain may have such a structure that non-layered portions different in the halide composition are provided inside the grain or on the grain surface (when provided on the grain surface, the portions are conjugated at edges, corners or on planes), and these are appropriately selected depending on the use. For achieving high sensitivity, either of the latter two cases is advantageously used rather than the grain of uniform-type structure and also preferred in view of pressure durability. When the silver halide grain has either of the above-described structures, the boundary between portions different in the halide composition may be clear, may be ambiguous because of mixed crystals formed due to difference in the composition, or may have sequential structural change provided positively.

The high silver chloride emulsion used in the present invention preferably has such a structure that a silver bromide localized phase in the layer or non-layer form is present in the inside and/or on the surface of a silver halide grain as described above. In the halide composition of the above-described localized phase, the silver bromide content is preferably at least 10 mole %, more preferably exceeds 20 mole %. The silver bromide content of the silver bromide localized phase can be analyzed according to the X-ray diffraction method (as described, for example, in *Shin-likken Kagaku Koza* 6, *Kozo-Kaiseki*, compiled by Nippon Kagaku Kai, Maruzen). The localized phase can be present at edges, corners or on planes inside the grain or on the surface of the grain and one preferred example is the case where the localized phase is epitaxially grown at the corner of a grain.

It is also effective to further increase the silver chloride content of silver halide emulsions so as to reduce the replenishing amount of the development processing solution. In this case, an emulsion comprising nearly pure silver chloride having a silver chloride content of from 98 to 100 mole % is also preferably used.

The silver halide grain contained in the silver halide emulsion used in the present invention has an average grain size (a number average of diameters with the diameter of a circle equivalent to the projected area of a grain being taken as a grain size) of preferably from 0.1 to 2 μm.

The coefficient of fluctuation in the grain size distribution (obtained by dividing the standard deviation of the grain size distribution by the average grain size) is 20% or less, preferably 15% or less, more preferably 10% or less, namely, a so-called monodisperse emulsion is preferred. For the purpose of obtaining a wide latitude, it is also preferred to blend monodisperse emulsions as described above in the same layer or coat the monodisperse emulsions in a superposed fashion.

The silver halide grain contained in the photographic emulsion may have a regular crystal form such as a cubic, tetradecahedral or octahedral form, an irregular crystal form such as a spherical or tabular form, or a composite form of these. Also, a mixture of grains having various crystal forms may be used. In the present invention, grains having the above-described regular crystal form preferably accounts for 50% or more, more preferably 70% or more, still more preferably 90% or more. An emulsion where the projected area of tabular grains having an average aspect ratio (circle-converted diameter/thickness) of 5 or more, preferably 8 or more, exceeds 50% of that of all grains can also be preferably used.

The silver chloride/silver chlorobromide emulsion used in the present invention can be prepared according to the methods described in P. Glafkides, *Chimie et Phisique Photographique*, Paul Montel (1967), G. F. Duffin, *Photographic Emulsion Chemistry*, The Focal Press (1966) or V. L. Zelikman et al, *Making and Coating Photographic Emulsion*, The Focal Press (1964). More specifically, any of acid process, neutral process and ammonia process may be used and the reaction between a soluble silver salt and a soluble halogen salt may be conducted by a single jet method, a double jet method or a combination of these. Also, the grain can be formed in an atmosphere of excess silver ions (so-called reverse mixing method). A so-called controlled double jet method, which is one system of the double jet method, of keeping constant the pAg of the liquid phase where the silver halide is formed can also be used. According to this method, the silver halide emulsion obtained can be composed of grains having a regular crystal form and a nearly uniform grain size.

The localized phase or substrate of the silver halide grain of the present invention preferably contains different kinds of metal ions or their complex ions. Preferred metals are selected from metal ions or metal complexes belonging to Group VIII and Group IIb of the Periodic Table, a lead ion and a thallium ion. In the localized phase, ions of iridium, rhodium or iron, complex ions thereof or a mixture of these are mainly used and in the substrate, metal ions of osmium, iridium, rhodium, platinum, ruthenium, palladium, cobalt, nickel or iron, complex ions thereof or a combination of these are mainly used. The kind and concentration of the metal ion may be changed between the localized phase and the substrate. Plural kinds of these metals may also be used. In particular, it is preferred to let an iron or iridium compound be present in a silver bromide localized phase.

The above-described metal ion-providing compound is added to a dispersion medium such as an aqueous gelatin solution, an aqueous halide solution, an aqueous silver salt solution or other aqueous solutions during formation of silver halide grains, or silver halide fine grains having incorporated therein metal ions in advance are added to the aqueous solution and then the fine grains are dissolved therein, whereby the metal ions are incorporated into the localized phase and/or other portions of the grain (substrate).

The metal ion used in the present invention can be incorporated into the emulsion grains before grain formation, during grain formation or immediately after grain formation. The addition time may be changed according to the portion of the grain to which the metal ions are incorporated.

The silver halide emulsion for use in the present invention is usually subjected to chemical sensitization and spectral sensitization.

The chemical sensitization may be performed by effecting chemical sensitization using a chalcogen sensitizer (specifically, sulfur sensitization represented by the addition of a labile sulfur compound, selenium sensitization using a selenium compound or tellurium sensitization using a tellurium compound), noble metal sensitization represented by gold sensitization, or reduction sensitization, individually or in combination. Preferred examples of the compound for use in the chemical sensitization include those described in JP-A-62-215272, from page 18, right lower column to page 22, right upper column.

The effect provided by the construction of the photographic light-sensitive material of the present invention is outstanding when a high silver chloride emulsion subjected to gold sensitization is used. The emulsion used in the present invention is a so-called surface latent image-type emulsion where a latent image is mainly formed on the grain surface.

The silver halide emulsion for use in the present invention may contain various compounds or precursors thereof for the purpose of preventing fogging during preparation, storage or photographic processing of a photographic material, or for stabilizing the photographic performance. Specific and preferred examples of these compounds include those described in JP-A-62-215272, pp. 39–72. The 5-arylamino-1,2,3,4-thiatriazole compound (the aryl residue having at least one electron-attractive group) described in European Patent 0447647 is also preferably used.

The photographic material of the present invention is subjected to spectral sensitization so as to impart spectral sensitivity at a desired light wavelength region to the emulsion of each layer.

Examples of the spectral sensitization dye used for spectral sensitization of the photographic material of the present invention at blue, green and red regions include those described in F. M. Hamer, *Heterocyclic Compounds-Cyanine Dyes and Related Compounds*, John Wiley & Sons, New York, London (1964). Specific and preferred examples of the compound and the spectral sensitization method include those described in JP-A-62-215272, from page 22, right upper column to page 38. Particularly, as the red-sensitive spectral sensitizing dye for silver halide emulsion grains having a high silver chloride content, spectral sensitizing dyes described in JP-A-3-123340 are very preferred in view of stability, strength of adsorption and temperature dependency of exposure.

For effecting spectral sensitization of the photographic material of the present invention at an infrared region efficiently, sensitizing dyes described in JP-A-3-15049, from page 12, left upper column to page 21, left lower column, JP-A-3-20730, from page 4, left lower column to page 15, left lower column, European Patent 0420011, from page 4, line 21 to page 6, line 54, European Patent 0420012, from page 4, line 12 to page 10, line 33, European Patent 0443466 and U.S. Pat. No. 4,975,362 are preferably used.

Such a spectral sensitizing dye may be incorporated into a silver halide emulsion by dispersing the dye directly in the emulsion or may be dissolved in a single solvent such as water, methanol, ethanol, propanol, methyl cellosolve or 2,2,3,3-tetrafluoropropanol or a mixed solvent of these and then added to the emulsion. Also, an aqueous solution of the dye with an acid or a base being present together as described in JP-B-44-23389 (the term "JP-B" as used herein means an "examined Japanese patent publication"), JP-B-44-27555 and JP-B-57-22089, or an aqueous solution or colloid dispersion of the dye with a surface active agent being present together as described in U.S. Pat. Nos. 3,822,135 and 4,006,025 may be added to the emulsion. Further, the dye may be dissolved in a solvent substantially incompatible with water such as phenoxyethanol, dispersed in water or a hydrophilic colloid and then added to an emulsion. Furthermore, the dye may be dispersed directly in a hydrophilic colloid and the dispersion may be added to an emulsion as described in JP-A-53-102733 and JP-A-58-105141. The time when the dye is added to the emulsion may be any stage hitherto considered useful during preparation of an emulsion. More specifically, it may be added before grain formation of a silver halide emulsion, during the grain formation, between immediately after the grain formation and prior to entering into a washing step, before chemical sensitization, during chemical sensitization, between immediately after chemical sensitization and solidification under cooling of the emulsion, or during preparation of coating solutions. Most commonly, the dye is added to the emulsion after completion of chemical sensitization prior to coating but the dye may be added at the same time with a chemical sensitizer to effect spectral sensitization and chemical sensitization simultaneously as described in U.S. Pat. Nos. 3,628,969 and 4,225,666, the dye may be added in advance of chemical sensitization as described in JP-A-58-113928, or the dye may be added before the precipitation of silver halide grains is completed to start spectral sensitization. Further, the spectral sensitizing dye may be added in sections, namely, a part may be added prior to chemical sensitization and the remaining may be added after chemical sensitization as described in U.S. Pat. No. 4,225,666, and the addition may be effected in any stage during formation of silver halide grains as described in U.S. Pat. No. 4,183,756. In particular, the sensitizing dye is preferably added before water washing or before chemical sensitization of the emulsion.

The addition amount of the spectral sensitizing dye changes over a wide range according to the case but it is preferably in the range from $0.5\times10^{-6}$ to $1.0\times10^{-2}$ mole, more preferably from $1.0\times10^{-6}$ to $5.0\times10^{-3}$ mole, per mole of silver halide.

When a sensitizing dye having a spectral sensitization sensitivity, particularly, in regions of from red to infrared is used in the present invention, compounds described in JP-A-2-157749, from page 13, right lower column to page 22, right lower column are preferably used in combination. By using such a compound, preservability and processing stability of the photographic material and supersensitization effect can be peculiarly increased. In particular, compounds represented by formulae (IV), (V) and (VI) of JP-A-2-157749 are preferably used in combination. Such a compound is used advantageously in an amount of from $0.5\times10^{-5}$ to $5.0\times10^{-2}$ mole, preferably from $5.0\times10^{-5}$ to $5.0\times10^{31\ 3}$ mole, pre mole of silver halide, and in a range from 0.1 to 10,000 times, preferably from 0.5 to 5,000 times, per mole of a sensitizing dye.

The photographic material of the present invention is used for a printing system using a normal negative printer and in addition, preferably used for a digital scan exposure using a monochromatic high density light such as a gas laser, a light emitting diode, a semiconductor laser or a second harmonic generation source (SHG) using a combination of a nonlinear optical crystal with a semiconductor laser or a solid-state laser using a semiconductor laser as an excitation source. In order to render the system compact and inexpensive, the semiconductor laser or the second harmonic generation source (SHG) using a combination of a nonlinear optical crystal with a semiconductor laser or a solid-state laser may be preferably used. In particular, when a compact, cheap and highly stable device having a long life is intended, the use of a semiconductor laser is preferred and it is preferred to use a semiconductor laser as at least one of light sources for exposure.

When such a light source for scan exposure is used, the spectral sensitivity maximum of the photographic material of the present invention may be freely established according to the wavelength of the light source for scan exposure used. In the case of SHG source using a combination of nonlinear optical crystal with a semiconductor laser or a solid-state laser using a semiconductor laser as an excitation source, the oscillation wavelength of laser can be made half and accordingly, a blue light and a green light can be obtained. Thus, the photographic material can have a spectral sensitivity maximum at three regions of normal blue, green and red. When a semiconductor laser is used as a light source to render the device cheap, highly stable and compact, at least two layers are preferred to have a spectral sensitivity maximum at 670 nm or higher. This is because the cheap and stable Group III–V type semiconductor laser now available has a light-emitting wavelength region at from red to infrared regions. However, on a laboratory level, it is confirmed that the Group II–VI type semiconductor laser oscillates at green or blue region and accordingly, it can be well expected that if a production technique of semiconductor lasers is advanced, such a semiconductor laser would be used cheaply and stably. If so, the necessity that at least two layers must have a spectral sensitivity maximum at 670 nm or higher would be eliminated.

In such a scan exposure, the exposure time for the silver halide of a photographic material means the time required to expose a certain fine area. The fine area is generally a minimum unit for controlling the quantity of light from respective digital data and called a picture element. Accordingly, the exposure time per picture element varies depending on the size of the picture element. The size of the picture element depends on the picture element density which is practically in the range from 50 to 2,000 dpi. If the exposure time is defined as the time required to expose a picture element in a size such that the picture element density is 400 dpi, the exposure time is preferably $10^{-4}$ second or less, more preferably $10^{-6}$ second or less.

In the photographic material according to the present invention, the hydrophilic colloidal layer preferably contains a dye (particularly, an oxonol dye or a cyanine dye) capable of being decolorized on processing described in EP 0337490A2, pp. 27–76, so as to prevent irradiation or halation or to improve safety for the safelight.

Some water-soluble dyes described above may worsen the color separation or safety for the safelight when they are used in an increased amount. As the dye which can be used without causing any deterioration in color separation, water-soluble dyes described in European Patent 0539978, JP-A-05-127325 and JP-A-05-127324 are preferred.

In the present invention, a colored layer may be provided which is used in place of a water-soluble dye or in combination with a water-soluble dye and can be decolored on processing. The colored layer capable of being decolored on processing may be put into direct contact with the emulsion layer or may be provided through an interlayer containing gelatin or a processing color mixing inhibitor such as hydroquinone. The colored layer is preferably provided as an underlayer (on the support side) of an emulsion layer to be colored to the same elementary color as the color of the colored layer. Colored layers corresponding to all elementary colors may be individually provided or a part of such colored layers may be freely selected and provided. Also, a colored layer colored so as to correspond to a plurality of elementary color regions may be provided. With respect to the optical reflection density of the colored layer, the optical density at a wavelength having the highest optical density in the wavelength regions used for exposure (in a visible light region of from 400 to 700 nm in the case of a normal printer exposure and at a wavelength of the scan exposure source used in the case of scan exposure) is preferably from 0.2 to 3.0, more preferably from 0.5 to 2.5, most preferably from 0.8 to 2.0.

The colored layer can be formed according to conventionally known methods. For example, a method where a dye as described in JP-A-2-282244, from page 3, right upper column to page 8, or a dye as described in JP-A-3-7931, from page 3, right upper column to page 11, left lower column is incorporated into a hydrophilic colloid layer in the sate of a solid fine particle dispersion, a method where an anionic dye is mordanted to a cation polymer, a method where a dye is adsorbed to a fine particle, for example, of silver halide to fix it in the layer, or a method using colloidal sliver as described in JP-A-1-239544 may be used. An example of the method for dispersing fine particles of a dye in the solid state include a method described in JP-A-2-308244, pp. 4–13, which comprises incorporating a fine powder dye substantially water-insoluble at a pH of 6 or less but substantially water-soluble at a pH of 8 or more. The method for mordanting an anionic dye to a cation polymer is described, for example, in JP-A-2-84637, pp. 18–26. The preparation method of colloidal silver as a light absorbent is described in U.S. Pat. Nos. 2,688,601 and 3,459,563. Among these methods, preferred are a method comprising incorporating a fine powder dye and a method using colloidal silver.

Gelatin is advantageous as the binder or protective colloid which can be used in the photographic material according to the present invention, but other hydrophilic colloids may be used solely or in combination with gelatin. Preferred gelatin is a low-calcium gelatin having a calcium content of 800 ppm or less, more preferably 200 ppm or less. Further, an antimold as described in JP-A-63-271247 is preferably added for preventing proliferation of various molds or bacteria in the hydrophilic colloidal layer which cause deterioration of an image.

At the time when the photographic material of the present invention is subjected to printer exposure, a band stop filter described in U.S. Pat. No. 4,880,726 is preferably used. By using this filter, color mixing is eliminated and color reproduction is outstandingly improved.

The exposed photographic material may be subjected to common color development but the color photographic material of the present invention is preferably subjected to color development and then to bleach-fixing for the purpose of a rapid processing. In particular, in the case where the above-described high silver chloride emulsion is used, the pH of the bleach-fixing solution is preferably about 6.5 or less, more preferably about 6 or less in order to accelerate desilvering.

With respect to the silver halide emulsion, other materials (e.g., additives), photographic constituent layers (e.g., layer arrangement) applicable to the photographic material according to the present invention, the processing method for processing the photographic material, and additives used for processing, those described in the following patents, in particular, EP 0355660A2 (corresponding to JP-A-2-139544) are preferably used.

| Photographic Constituent Element | JP-A-62-215272 | JP-A-2-33144 | EP 0355622A2 |
|---|---|---|---|
| Silver halide emulsion | p. 10, right upper col., line 6 to p. 12, left lower col., line 5 and p. 12, right lower col., line 4 from the bottom to p. 13, left upper col. line 17 | p. 28, right upper col., line 16 to p. 29, right lower col., line 11 and p. 30, lines 2 to 5 | p. 45, line 53 to p. 47, line 3 and p. 47, lines 20 to 22 |
| Silver halide solvent | p. 12, left lower col., lines 6 to 14 and p. 13, left upper col., line 3 from the bottom to p. 18, left lower col., last line | — | — |
| Chemical sensitizer | p. 12, left lower col., line 3 from the bottom to right lower col., line 5 from the bottom, p. 18, right lower col., line 1 to p. 22, right upper col., line 9 from the bottom | p. 29, right lower col., line 12 to last line | p. 47, lines 4 to 9 |
| Spectral sensitizer (spectral sensitization) | p. 22, right upper col., line 8 from the bottom to p. 38, last line | p. 30, left upper col., lines 1 to 13 | p. 47, lines 10 to 15 |
| Emulsion stabilizer | p. 39, left upper col., line 1 to p. 72, right upper col., last line | p. 30, left upper col., line 14 to right upper col., line 1 | p. 47, lines 16 to 19 |
| Development accelerator | p. 72, left lower col., line 1 to p. 91, right upper col., line 3 | — | — |

-continued

| Photographic Constituent Element | JP-A-62-215272 | JP-A-2-33144 | EP 0355622A2 |
|---|---|---|---|
| Color coupler (cyan, magenta, yellow couplers) | p. 91, right upper col., line 4 to p. 121, left upper col., line 6 | p. 3, right upper col., line 14 to p. 18, left upper col., last line and p. 30, right upper col., line 6 to p. 35, right lower col., line 11 | p. 4, lines 15 to 27, p. 5, line 30 to p. 28, last line, p. 45, lines 29 to 31 and p. 47, line 23 to p. 63, line 50 |
| Coloration increasing agent | p. 121, left lower col., line 7 to p. 125, right upper col., line 1 | — | — |
| Ultraviolet absorbent | p. 125, right upper col., line 2 to p. 127, left lower col., last line | p. 37, right lower col., line 14 to p. 38, left upper col., line 11 | p. 65, lines 22 to 31 |
| Discoloration inhibitor (image stabilizer) | p. 127, right lower col., line 1 to p. 137, left lower col., line 8 | p. 36, right upper col., line 12 to p. 37, left upper col., line 19 | p. 4, line 30 to p. 5, line 23, p. 29, line 1 to p. 45, line 25, p. 45, lines 33 to 40, p. 65, lines 2 to 21 |
| High boiling point and/or low boiling point organic solvent | p. 137, left lower col., line 9 to p. 144, right upper col., last line | p. 35, right lower col., line 14 to p. 36, left upper col., line 4 from the bottom | p. 64, lines 1 to 51 |
| Dispersion method of photographic additives | p. 144, left lower col., line 1 to p. 146, right upper col., line 7 | p. 27, right lower col., line 10 to p. 28, left upper col., last line and p. 35, right lower col., line 12 to p. 36, right upper col., line 7 | p. 63, line 51 to p. 64, line 56 |
| Hardening agent | p. 146, right upper col., line 8 to p. 155, left lower col., line 4 | — | — |
| Developing agent precursor | p. 155, left lower col., line 5 to p. 155, right lower col., line 2 | — | — |
| Development inhibitor-releasing compound | p. 155, right lower col., lines 3 to 9 | — | — |
| Support | p. 155, right lower col., line 19 to p. 156, left upper col., line 14 | p. 38, right upper col., line 18 to p. 39, left upper col., line 3 | p. 66, line 29 to p. 67, line 13 |
| Photographic material layer structure | p. 156, left upper col., line 15 to p. 156, right lower col., line 14 | p. 28, right upper col., lines 1 to 15 | p. 45, lines 41 to 52 |
| Dyestuff | p. 156, right lower col., line 15 to p. 184, right lower col., last line | p. 38, left upper col., line 12 to right upper col., line 7 | p. 66, lines 18 to 22 |
| Color mixing inhibitor | p. 185, left upper col., line 1 to p. 188, right lower col., line 3 | p. 36, right upper col., lines 8 to 11 | p. 64, line 57 to p. 65, line 1 |
| Gradation controlling agent | p. 188, right lower col., lines 4 to 8 | — | — |
| Stain inhibitor | p. 188, right lower col., line 9 to p. 193, right lower col., line 10 | p. 37, left upper col., last line to right lower col., line 13 | p. 65, line 32 to p. 66, line 17 |
| Surface active agent | p. 201, left lower col., line 1 to p. 210, right upper col., last line | p. 18, right upper col., line 1 to p. 24, right lower col., last line and p. 27, left lower col., line 10 from the bottom to right lower col., line 9 | — |
| Fluorine-containing compound (antistatic agent, coating aid, lubricant, adhesion-preventing agent) | p. 210, left lower col., line 1 to p. 222, left lower col., line 5 | p. 25, left upper col., line 1 to p. 27, right upper col., line 9 | — |
| Binder (hydrophilic colloid) | p. 222, left lower col., line 6 to p. 225, left upper col., last line | p. 38, right upper col., lines 8 to 18 | p. 66, lines 23 to 28 |
| Thickener | p. 225, right upper col., line 1 to p. 227, right upper col., line 2 | — | — |
| Antistatic agent | p. 227, right upper col., line 3 to p. 230, left upper col., line 1 | — | — |
| Polymer latex | p. 230, left upper col., line 2 to p. 239, last line | — | — |

-continued

| Photographic Constituent Element | JP-A-62-215272 | JP-A-2-33144 | EP 0355622A2 |
|---|---|---|---|
| Matting agent | p. 240, left upper col., line 1 to p. 240, right upper col., last line | — | — |
| Photographic processing (processing) steps and additives) | p. 3, right upper col., line 7 to p. 10, right upper col., line 5 | p. 39, left upper col., line 4 to p. 42, left upper col., last line | p. 67, line 14 to p. 69, line 28 |

Note)
The disclosure of JP-A-62-215272 referred to herein includes the amendments set forth in the written revision filed on March 16, 1987 which is attached to the end of the publication.
Among color couplers, as the yellow coupler, so-called shortwave-type yellow couplers described in JP-A-63-231451, JP-A-63-123047, JP-A-63-241547, JP-A-1-173499, JP-A-1-213648 and JP-A-1-250944 are also preferably used.

Preferred examples of the water-insoluble and organic solvent-soluble polymer include homopolymers and copolymers described in U.S. Pat. No. 4,857,449, cols. 7–15, and International Patent W088/00723, pp. 12–30. Methacrylate-based or acrylamide-based polymers are more preferred and acrylamide-based polymers are particularly preferred in view of color image stability.

The photographic material according to the present invention preferably uses a color image preservability improving compound as described in EP 0277589A2 in combination with couplers, particularly in combination with a pyrazoloazole coupler, a pyrrolotriazole coupler or an acylacetamide-type yellow coupler.

More specifically, compounds described in the European patent above which forms a chemically inert and substantially colorless compound by making a chemical bonding to an aromatic amine developing agent remained after color development and/or compounds described in the European patent above which forms a chemically inert and substantially colorless compound by making a chemical bonding to the oxidation product of an aromatic amine color developing agent remained after color development are preferably used individually or in combination to prevent the occurrence of stains or other side effects resulting from formation of a color dye due to the reaction during storage after processing of a coupler with a color developing agent or an oxidation product thereof remained in the film.

In addition to the foregoing, examples of preferred cyan couplers include diphenylimidazole-based cyan couplers described in JP-A-2-33144, 3-hydroxypyridine-based cyan couplers described in EP 0333185A2, cyclic active methylene-based cyan couplers described in JP-A-64-32260, pyrrolo-pyrazole-type cyan couplers described in EP 0456226A1, pyrroloimidazole-type cyan couplers described in European Patent 0484909 and pyrrolotriazole-type cyan couplers described in European Patent 0488248 and EP 0491197A1. Among these, particularly preferred are pyrrolotriazole-type cyan couplers.

The magenta coupler used in the present invention may be a 5-pyrazolone-based magenta coupler or a pyrazoloazole-based magenta coupler described in publications in the table above but, in particular, in view of hue and image stability or color forming property, pyrazolotriazole couplers having a secondary or tertiary alkyl group bonded directly to the 2-, 3- or 6-position of the pyrazolotriazole ring described in JP-A-61-65245, pyrazoloazole couplers having a sulfonamido group in the molecule described in JP-A-61-65246, pyrazoloazole couplers having an alkoxyphenylsulfonamido ballast group described in JP-A-61-147254 and pyrazoloazole couplers having an alkoxy group or an aryloxy group at the 6-position described in EP 226849A and EP 294785A are preferred.

The yellow coupler used is preferably known acylacetanilide-based couplers and preferred among these are pivaloylacetanilide-based couplers having a halogen atom or an alkoxy group at the ortho-position of the anilide ring, acylacetanilide-based couplers with the acyl group being a cycloalkanecarbonyl group substituted at the 1-position described in EP 0447969A, JP-A-5-107701 and JP-A-5-113642, and malondianilide-based couplers described in EP 0482552A and EP 0524540A.

With respect to the processing method of the color photographic material of the present invention, in addition to the methods described in the table above, processing materials and processing methods described in JP-A-2-207250, from page 26, right lower column, line 1 to page 34, right upper column, line 9 and JP-A-4-97355, from page 5, left upper column, line 17 to page 18, right lower column, line 20 are preferred.

According to the present invention, a silver halide photographic light-sensitive material can be obtained, which contains a fine emulsified dispersion containing little coarse grains and excellent aging stability and is suppressed from the peeling in layers upon contact or adhesion of an emulsion surface to other materials at a high humidity.

The present invention will be described in greater detail with reference to the following examples but the present invention should not be construed as being limited thereto.

EXAMPLE 1

150 g of Polymer (P-16) (number average molecular weight: 590) of the present invention, 1,100 g of Ultraviolet Absorbent (UV-2) and 300 ml of ethyl acetate were dissolved under heating at 500° C. and the resulting solution was emulsion-dispersed in 5,000 g of a 20 wt% aqueous gelatin solution containing 700 ml of an aqueous solution of a 10% sodium dodecylbenzenesulfonate by means of a high-speed agitation emulsifier (emulsified with blades for dispersion having a diameter of 65 mm at 5,000 rpm for 20 minutes). After the completion of emulsification, water was added thereto and well mixed to obtain Emulsified Dispersion Sample No. 109 in a total amount of 12,000 g (Table A).

Emulsified Dispersion Sample Nos. 101 to 120 were prepared thoroughly in the same manner as Sample No. 109 except for changing the kind of the polymer as shown in Table A (Emulsification A). In Sample No. 107, a polymer was not added.

TABLE A

R-1

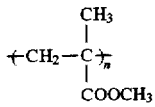

R-2

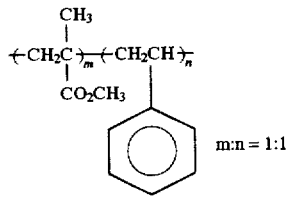

m:n = 1:1

R-3

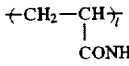

ExY-2

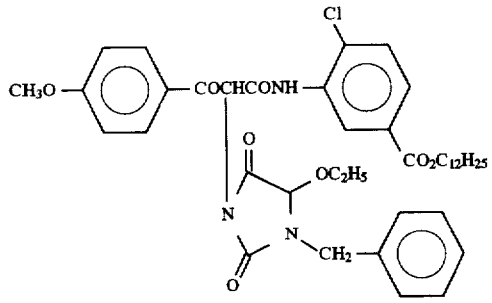

| Sample No. | Emulsification | Structure of Polymer | Number Average Molecular Weight | Remarks |
|---|---|---|---|---|
| 101 | A | P-12 | 15,000 | Comparison |
| 102 | A | P-12 | 590 | Invention |
| 103 | A | P-1 | 15,000 | Comparison |
| 104 | A | P-1 | 570 | Invention |
| 105 | A | R-1 | 13,000 | Comparison |
| 106 | A | R-1 | 600 | Comparison |
| 107 | A | none | — | Comparison |
| 108 | A | P-16 | 300 | Invention |
| 109 | A | " | 590 | Invention |
| 110 | A | " | 1,900 | Invention |
| 111 | A | " | 3,900 | Invention |
| 112 | A | " | 8,000 | Comparison |
| 113 | A | " | 15,000 | Comparison |
| 114 | A | P-26 | 500 | Invention |
| 115 | A | P-9 | 1,500 | Invention |
| 116 | A | P-24 | 1,000 | Invention |
| 117 | A | R-2 | 600 | Comparison |
| 118 | A | " | 13,000 | Comparison |
| 119 | A | R-3 | 570 | Comparison |
| 120 | A | " | 13,000 | Comparison |

Evaluations 1 and 2 described below were conducted examine the storage stability of dispersions and the obtained are shown in Table B.

Evaluation 1

(Grain size immediately after emulsification and after cold storage)

The average grain size was determined immediately after emulsification and after cold storage (at 4° C.) for one month by means of Coulter Submicron Particle Analyzer Model N4 manufactured by Coulter Electronics Co., Ltd.

Evaluation 2

(Coarse grain number in dispersion immediately after emulsification and after storage at room temperature)

200 g of a 10% aqueous gelatin solution was added to 50 g of an emulsified product and dissolved and mixed at 40° C and 5.0 ml of the resulting mixture was coated on a transparent glass plate of 100 $cm^2$. After air drying, the number of coarse grains having a diameter of 20 μm or more present per 1 $cm^2$ was counted through an optical microscope and an average of the numbers at five portions was calculated. The coarse grain is ascribable to poor dispersion or deposition of photographic raw materials and accordingly, the smaller the number of coarse grains, the better.

As shown in Table B, when the polymer of the present invention was used, the emulsified dispersion immediately after emulsification had a small average grain size and the number of coarse grains was clearly small as compared with those using a polymer of the same structure but having a number average molecular weight of 4,000 or more.

In the case when the number of coarse grains in the emulsified product is increased extremely, the photographic light-sensitive material using the emulsified dispersion owes many defects and the viewing thereof can hardly be endured. Also, in general, when a coupler-containing emulsified dispersion having a small grain size of the emulsified product is used, the maximum color density obtained is high and in the case of an ultraviolet absorbent-containing emulsified dispersion, improvements in the performance such as an increase in the ability to cut the ultraviolet light can be expected. It is also important to prevent the increase in the grain size and the number of coarse grains during storage of the emulsified dispersion.

TABLE B

| Sample No. | Number of Coarse Grain (/$cm^2$) Immediately After Emulsification | After Aging (1 month at room temp.) | Average Grain Size (μm) Immediately after Emulsification | After Aging (1 month at 4° C.) | Remarks |
|---|---|---|---|---|---|
| 101 | 3.0 | 5.0 | 0.95 | 1.09 | Comparison |
| 102 | 0.4 | 1.2 | 0.11 | 0.14 | Invention |
| 103 | 4.0 | 5.8 | 0.94 | 1.09 | Comparison |
| 104 | 0.6 | 2.0 | 0.10 | 0.14 | Invention |
| 105 | 4.0 | 12.6 | 0.95 | 1.02 | Comparison |
| 106 | 1.0 | 14.8 | 0.10 | 0.16 | Comparison |
| 107 | 1.0 | 7.2 | 0.10 | 0.23 | Comparison |

TABLE B-continued

| Sample No. | Number of Coarse Grain (/cm²) Immediately After Emulsification | After Aging (1 month at room temp.) | Average Grain Size (μm) Immediately after Emulsification | After Aging (1 month at 4° C.) | Remarks |
|---|---|---|---|---|---|
| 108 | 0.6 | 1.6 | 0.10 | 0.16 | Invention |
| 109 | 0.6 | 1.2 | 0.11 | 0.14 | Invention |
| 110 | 1.0 | 1.8 | 0.13 | 0.17 | Invention |
| 111 | 3.0 | 5.0 | 0.21 | 0.25 | Invention |
| 112 | 3.8 | 26.2 | 0.65 | 0.73 | Comparison |
| 113 | 8.6 | 35.0 | 0.90 | 0.99 | Comparison |
| 114 | 0.4 | 1.4 | 0.10 | 0.14 | Invention |
| 115 | 1.0 | 1.8 | 0.16 | 0.19 | Invention |
| 116 | 1.0 | 1.8 | 0.15 | 0.18 | Invention |
| 117 | 1.0 | 18.8 | 0.11 | 0.16 | Comparison |
| 118 | 11.8 | 46.0 | 0.95 | 1.02 | Comparison |
| 119 | 1.6 | 21.7 | 0.14 | 0.41 | Comparison |
| 120 | 9.0 | 31.0 | 0.81 | 0.94 | Comparison |

As is seen from Table B, the emulsified dispersion samples each containing a polymer of the present invention had a small number of coarse grains immediately after emulsification and the number of coarse grains did not increase extremely during storage as compared with Comparative Sample Nos. 101, 103, 105, 112, 113, 118 and 120 each using a high molecular polymer and Comparative Sample Nos. 106, 117 and 119 having a low percentage of the aromatic ring in the molecule. Samples each using a polymer of the present invention also had a fine average particle size and showed excellent stability during storage.

EXAMPLE 2

300 g of Polymer (P-16) (number average molecular weight: 590), 450 g of Ultraviolet Absorbent (UV-1), 450 g of Magenta Coupler (ExM), 40 g of Dye Image Stabilizer (Cpd-2), 40 g of Dye Image Stabilizer (Cpd-5), 30 g of Dye Image Stabilizer (Cpd-6), 100 g of Dye Image Stabilizer (Cpd-8), 1,700 ml of a high boiling point organic solvent (a 2:1 mixture of Solv-4 and Solv-5) and 900 ml of ethyl acetate were dissolved under heating at 50° C. and the resulting solution was emulsion-dispersed in 5,000 g of a 20 wt % aqueous gelatin solution containing 600 ml of an aqueous solution of a 10% sodium dodecylbenzenesulfonate by means of a high-speed agitation emulsifier. After the completion of emulsification, water was added thereto and mixed well to obtain Emulsified Dispersion Sample No. 129 in a total amount of 17,000 g (Table C). Further, Emulsified Dispersion Sample Nos. 121 to 141 were prepared thoroughly in the same manner as Sample No. 129 except for changing the kind of the polymer as shown in Table C (Emulsification B). In Sample No. 127, a polymer was not added. Samples were evaluated in the same manner as in Example 1 and the results obtained are shown in Table D.

TABLE C

| Sample No. | Emulsification | Structure of Polymer | Number Average Molecular Weight | Remarks |
|---|---|---|---|---|
| 121 | B | P-12 | 15,000 | Comparison |
| 122 | B | P-12 | 590 | Invention |
| 123 | B | P-1 | 15,000 | Comparison |
| 124 | B | P-1 | 570 | Invention |
| 125 | B | R-1 | 13,000 | Comparison |
| 126 | B | R-1 | 600 | Comparison |
| 127 | B | none | — | Comparison |
| 128 | B | P-16 | 300 | Invention |
| 129 | B | " | 590 | Invention |
| 130 | B | " | 900 | Invention |
| 131 | B | " | 1,900 | Invention |
| 132 | B | " | 3,900 | Invention |
| 133 | B | " | 8,000 | Comparison |
| 134 | B | " | 15,000 | Comparison |
| 135 | B | P-26 | 500 | Invention |
| 136 | B | P-9 | 1,500 | Invention |
| 137 | B | P-24 | 1,000 | Invention |
| 138 | B | R-2 | 600 | Comparison |
| 139 | B | " | 13,000 | Comparison |
| 140 | B | R-3 | 570 | Comparison |
| 141 | B | " | 13,000 | Comparison |

TABLE D

| Sample No. | Number of Coarse Grain (/cm²) Immediately After Emulsification | After Aging (1 month at room temp.) | Average Grain Size (μm) Immediately after Emulsification | After Aging (1 month at 4° C.) | Remarks |
|---|---|---|---|---|---|
| 121 | 2.0 | 3.8 | 0.26 | 0.29 | Comparison |
| 122 | 0.2 | 1.4 | 0.18 | 0.21 | Invention |

TABLE D-continued

| Sample No. | Number of Coarse Grain (/cm²) Immediately After Emulsification | After Aging (1 month at room temp.) | Average Grain Size (μm) Immediately after Emulsification | After Aging (1 month at 4° C.) | Remarks |
|---|---|---|---|---|---|
| 123 | 2.0 | 5.4 | 0.25 | 0.30 | Comparison |
| 124 | 0.4 | 2.2 | 0.18 | 0.22 | Invention |
| 125 | 2.4 | 8.8 | 0.27 | 0.32 | Comparison |
| 126 | 1.0 | 8.2 | 0.18 | 0.24 | Comparison |
| 127 | 0.6 | 7.1 | 0.17 | 0.30 | Comparison |
| 128 | 0.2 | 1.6 | 0.16 | 0.20 | Invention |
| 129 | 0.6 | 1.6 | 0.17 | 0.20 | Invention |
| 130 | 0.8 | 1.8 | 0.17 | 0.20 | Invention |
| 131 | 1.0 | 2.1 | 0.18 | 0.21 | Invention |
| 132 | 2.3 | 4.8 | 0.20 | 0.22 | Invention |
| 133 | 2.8 | 15.6 | 0.74 | 0.89 | Comparison |
| 134 | 8.5 | 30.0 | 0.98 | 1.17 | Comparison |
| 135 | 0.2 | 1.8 | 0.18 | 0.23 | Invention |
| 136 | 0.8 | 2.2 | 0.21 | 0.25 | Invention |
| 137 | 0.6 | 1.8 | 0.19 | 0.26 | Invention |
| 138 | 1.2 | 19.2 | 0.18 | 0.23 | Comparison |
| 139 | 8.8 | 25.0 | 0.91 | 1.22 | Comparison |
| 140 | 1.9 | 28.0 | 0.20 | 0.27 | Comparison |
| 141 | 6.0 | 24.4 | 0.88 | 0.99 | Comparison |

As is seen from Table D, the emulsified dispersion samples each containing a polymer of the present invention had a small number of coarse grains and the number of coarse grains did not increase extremely during storage as compared with Comparative Sample Nos. 121, 123, 125, 133, 134, 139 and 141 each using a high molecular weight polymer and Comparative Sample Nos. 126, 138 and 140 each having a small percentage of the aromatic group in the molecule. The samples containing a polymer of the present invention also had a fine average grain size and showed excellent stability during storage.

EXAMPLE 3

100 g of Polymer (P-15) (number average molecular weight: 590) of the present invention, 1,200 g of Yellow Coupler (ExY-2), 250 ml of High Boiling Point Organic Solvent (Solv-3) and 1,000 ml of ethyl acetate were dissolved under heating at 50° C. and the resulting solution was emulsion-dispersed in 5,000 g of a 20 wt % aqueous gelatin solution containing 270 ml of an aqueous solution of a 10% sodium dodecylbenzenesulfonate by means of a high-speed agitation emulsifier. After the completion of emulsification, water was added thereto and well mixed to obtain Emulsified Dispersion Sample No. 143 in a total amount of 12,000 g (Table E).

Emulsified Dispersion Sample Nos. 142 to 148 were prepared thoroughly in the same manner as above except for changing the kind of the polymer as shown in Table E (Emulsification C). In Sample No. 148, a polymer was not added. The samples were evaluated in the same manner as in Example 1 and the results obtained are shown in Table F.

TABLE E

| Sample No. | Emulsification | Structure of Polymer | Number Average Molecular Weight | Remarks |
|---|---|---|---|---|
| 142 | C | P-15 | 15,000 | Comparison |
| 143 | C | P-15 | 590 | Invention |
| 144 | C | P-1 | 15,000 | Comparison |

TABLE E-continued

| Sample No. | Emulsification | Structure of Polymer | Number Average Molecular Weight | Remarks |
|---|---|---|---|---|
| 145 | C | P-1 | 570 | Invention |
| 146 | C | R-1 | 13,000 | Comparison |
| 147 | C | R-1 | 600 | Comparison |
| 148 | C | none | — | Comparison |

TABLE F

| Sample No. | Number of Coarse Grain (/cm²) Immediately After Emulsification | After Aging (1 month at room temp.) | Average Grain Size (μm) Immediately After Emulsification | After Aging (1 month at 4° C.) | Remarks |
|---|---|---|---|---|---|
| 142 | 2.4 | 4.8 | 0.22 | 0.26 | Comparison |
| 143 | 0.4 | 3.5 | 0.16 | 0.23 | Invention |
| 144 | 3.0 | 7.2 | 0.23 | 0.27 | Comparison |
| 145 | 0.8 | 3.0 | 0.16 | 0.21 | Invention |
| 146 | 3.6 | 11.4 | 0.23 | 0.27 | Comparison |
| 147 | 1.0 | 10.6 | 0.16 | 0.20 | Comparison |
| 148 | 1.2 | 9.5 | 0.15 | 0.25 | Comparison |

As is seen from Table F, the emulsified dispersion sample each containing a polymer of the present invention had a small number of coarse grains and the number of coarse grains did not increase extremely during storage as compared with Comparative Sample Nos. 142, 144 and 146 each using a high molecular polymer and Comparative Sample No. 147 having a low percentage of the aromatic ring in the molecule.

EXAMPLE 4

Preparation of Multi-Layer Color Printing Paper (Sample No. K107)

A paper support having laminated on both surfaces thereof polyethylene was subjected to surface treatment by corona discharge, then thereon a gelatin undercoat layer containing sodium dodecylbenzenesulfonate was provided and further thereon various photographic constituent layers were coated to prepare Multi-Layer Color Printing Paper Sample No. K107 having the layer structure described below. The coating solutions were prepared as follows.

Coating Solution for First Layer 122.0 g of Yellow Coupler (ExY), 15.4 g of Dye Image Stabilizer (Cpd-1), 7.5 g of Dye Image Stabilizer (Cpd-2) and 16.7 g of Dye Image Stabilizer (Cpd-3) were dissolved in 44 g of Solvent (Solv-1) and 180 ml of ethyl acetate, the resulting solution was emulsion-dispersed in 1,000 g of a 10% aqueous gelatin solution containing 86 ml of 10% sodium dodecylbenzenesulfonate to prepare Emulsified Dispersion A. Separately, Silver Chlorobromide Emulsion A (cubic form; a 3:7 mixture (by molar ratio in terms of silver) of Large-Size Emulsion A having an average grain size of 0.88 μm and Small-Size Emulsion A having an average grain size of 0.70 μm; the emulsions having a coefficient of fluctuation in grain size distribution of 0.08 and 0.10, respectively; the emulsions in respective sizes each containing 0.3 mole % of silver bromide localized on a part of the grain surface with the substrate being silver chloride) was prepared. In Silver Chlorobromide Emulsion A, Blue-Sensitive Sensitizing Dyes A, B and C each was added in an amount of $1.4\times10^{-4}$ mole for Large-Size Emulsion A and in an amount of $1.7\times10^{-4}$ mole for Small-Size Emulsion A. Also, Silver Chlorobromide Emulsion A was subjected to chemical ripening by adding a sulfur sensitizer and a gold sensitizer. The above-described Emulsified Dispersion A and Silver Chlorobromide Emulsion A were mixed and dissolved to prepare the coating solution for the first layer having the following composition. The coated amount of each emulsion indicates the amount calculated in terms of silver.

The coating solutions for the second to seventh layers were prepared in the same manner as the coating solution for the first layer. In the coating solution for the sixth layer, Emulsified Product No. 107 prepared in Example 1 was used. In each layer, 1-oxy-3,5-dichloro-s-triazine sodium salt was used as a gelatin hardening agent.

Further, Cpd-12, Cpd-13, Cpd-14 and Cpd-15 were added to each layer so as to give the total amount of 15.0 mg/m$^2$, 60.0 mg/m$^2$, 5.0 mg/m$^2$ and 10.0 mg/m$^2$, respectively.

The following spectral sensitizing dyes were used in the silver chlorobromide emulsion for each light-sensitive emulsion layer.

Blue-Sensitive Emulsion Layer:

Sensitizing Dye A

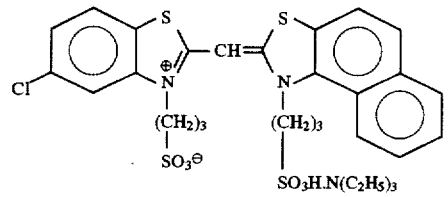

Sensitizing Dye B

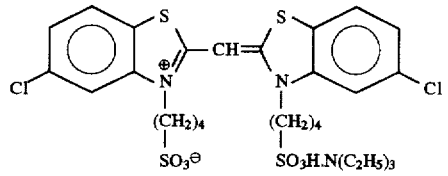

Sensitizing Dye C

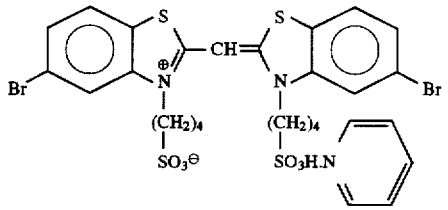

(each sensitizing dye was added in an amount of $1.4\times10^{-4}$ mole for the large-size emulsion and $1.7\times10^{-4}$ mole for the small-size emulsion, per mole of silver halide.)

Green-Sensitive Emulsion Layer:

Sensitizing Dye D

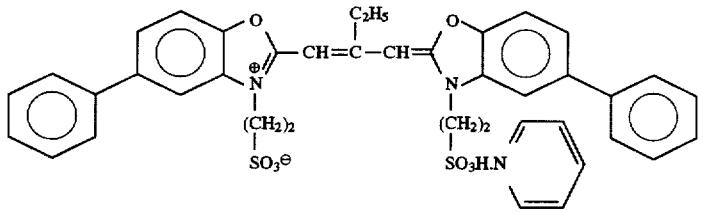

Sensitizing Dye E

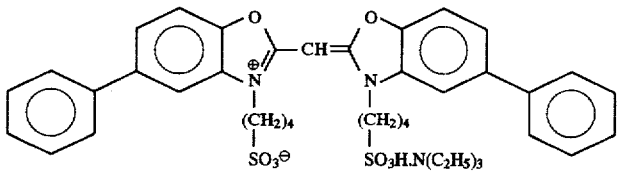

Sensitizing Dye F

-continued

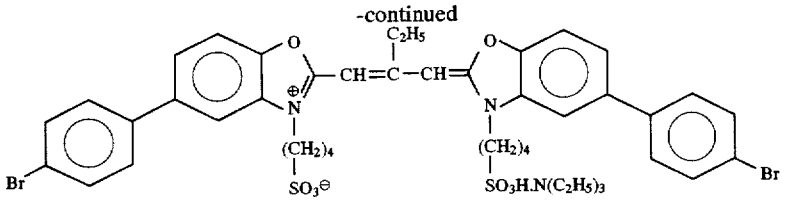

(Sensitizing Dye D was added in an amount of $3.0\times10^{-4}$ mole for the large-size emulsion and $3.6\times10^{-4}$ mole for the small-size emulsion, per mole of silver halide; Sensitizing Dye E was added in an amount of $4.0\times10^{-5}$ mole for the large-size emulsion and $7.0\times10^{-5}$ mole for the small-size emulsion, per mole of silver halide; and Sensitizing Dye F was added in an amount of $2.0\times10^{-4}$ mole for the large-size emulsion and $2.8\times10^{-4}$ mole for the small-size emulsion, per mole of silver halide.)

Red-Sensitive Emulsion Layer:

Sensitizing Dye G

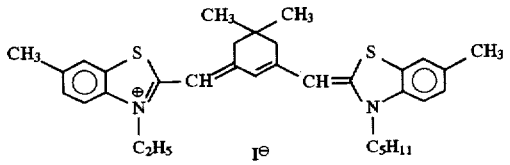

Sensitizing Dye H

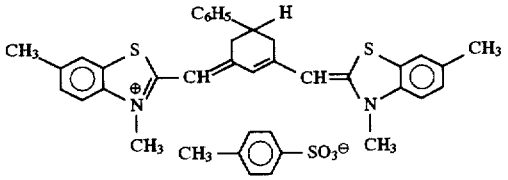

(each sensitizing dye was added in an amount of $5.0\times10^{-5}$ mole for the large-size emulsion and $8.0\times10^{-5}$ mole for the small-size emulsion).

In the red-sensitive emulsion layer, the following compound was further added in an amount of $2.6\times10^{-3}$ mole per mole of silver halide.

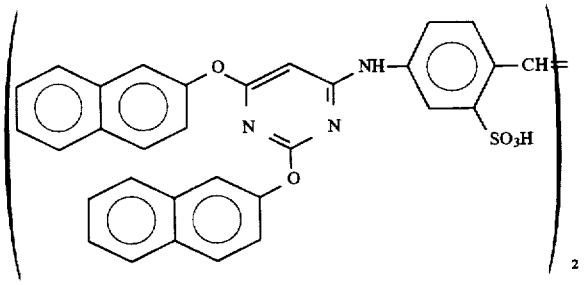

Further, 1-(5-methylureidophenyl)-5-mercaptotetrazole was added to the blue-sensitive emulsion layer, the green-sensitive emulsion layer and the red-sensitive emulsion layer in an amount of $3.5\times10^{-4}$ mole, $3.0\times10^{-3}$ mole and $2.5\times10^{-4}$ mole, respectively, per mole of silver halide.

Also, 4-hydroxy-6-methyl-1,3,3a,7-tetrazaindene was added to the blue-sensitive emulsion layer and the green-sensitive emulsion layer in an amount of $1\times10^{-4}$ mole and $2\times10^{-4}$ mole, respectively, per mole of silver halide.

In addition, the following dyes (the numerals in parenthesis indicate the coated amount) were added to each emulsion layer for the purpose of preventing irradiation.

(10 mg/m²)

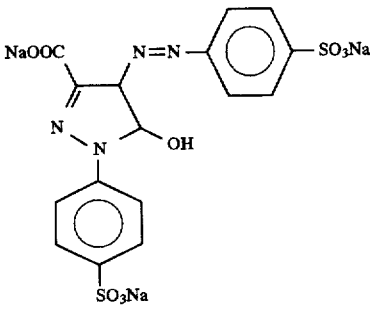

(20 mg/m²)

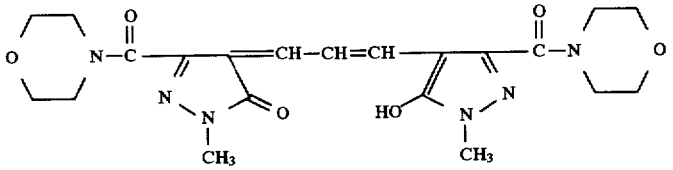

-continued

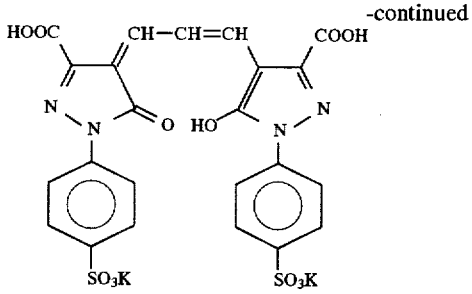

(5 mg/m²)

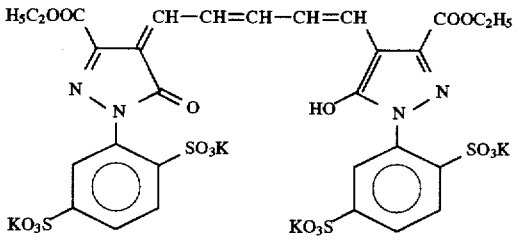

(40 mg/m²)

and

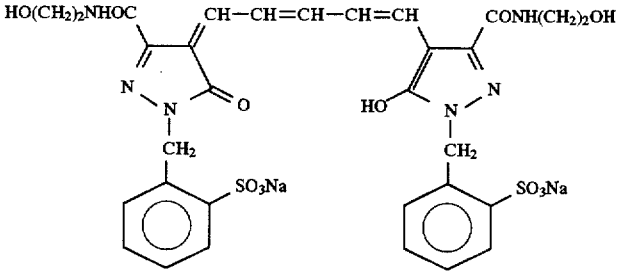

(20 mg/m²)

Layer Structure

Each layer had the following composition. Numerals show the coating amount (g/m²). The coating amount of silver halide emulsions was shown in terms of silver.

Support

Polyethylene laminated paper [Polyethylene on the first layer side contained a white pigment ($TiO_2$) and a bluish dye (ultramarine).]

| | |
|---|---|
| First Layer (Blue-Sensitive Emulsion Layer) | |
| Silver Chlorobromide Emulsion A described above | 0.24 |
| Gelatin | 1.33 |
| Yellow Coupler (ExY) | 0.61 |
| Dye Image Stabilizer (Cpd-1) | 0.08 |
| Dye Image Stabilizer (Cpd-2) | 0.04 |
| Dye Image Stabilizer (Cpd-3) | 0.08 |
| Solvent (Solv-1) | 0.22 |
| Second Layer (Color Mixing Preventing Layer) | |
| Gelatin | 1.09 |
| Color Mixing Inhibitor (Cpd-4) | 0.11 |
| Solvent (Solv-1) | 0.07 |
| Solvent (Solv-2) | 0.25 |
| Solvent (Solv-3) | 0.19 |
| Solvent (Solv-7) | 0.09 |
| Third Layer (Green-Sensitive Emulsion Layer) | |
| Silver Chlorobromide Emulsion (cubic; a 1:3 mixture (by Ag molar ratio) of Large-Size Emulsion B having an average grain size of 0.55 μm and Small-Size Emulsion B having an average grain size of 0.39 μm; the emulsions having a coefficient of fluctuation in grain size distribution of 0.10 and 0.08, respectively; the emulsions in respective sizes each containing 0.8 mole % of AgBr localized on a part of the grain surface with the substrate being silver chloride) | 0.11 |
| Gelatin | 1.19 |
| Magenta Coupler (ExM) | 0.12 |
| Ultraviolet Absorbent (UV-1) | 0.12 |
| Dye Image Stabilizer (Cpd-2) | 0.01 |
| Dye Image Stabilizer (Cpd-5) | 0.01 |
| Dye Image Stabilizer (Cpd-6) | 0.01 |
| Dye Image Stabilizer (Cpd-8) | 0.01 |
| Solvent (Solv-4) | 0.30 |
| Solvent (Solv-5) | 0.15 |
| Fourth Layer (Color Mixing Preventing Layer) | |
| Gelatin | 0.77 |
| Color Mixing Inhibitor (Cpd-4) | 0.08 |
| Solvent (Solv-1) | 0.05 |
| Solvent (Solv-2) | 0.18 |
| Solvent (Solv-3) | 0.14 |
| Solvent (Solv-7) | 0.06 |
| Fifth Layer (Red-Sensitive Emulsion Layer) | |
| Silver Chlorobromide Emulsion (cubic; a 1:4 mixture (by Ag molar ratio) of Large-Size Emulsion C having an average grain size of 0.50 μm and Small-Size Emulsion C having an average grain size of 0.41 μm; the emulsions having a coefficient of fluctuation in grain size distribution of | 0.18 |

-continued

| | |
|---|---|
| 0.09 and 0.11, respectively; the emulsions in respective sizes containing 0.8 mole % of AgBr localized on a part of the grain surface with the substrate being silver chloride) | |
| Gelatin | 0.80 |
| Cyan Coupler (ExC) | 0.28 |
| Ultraviolet Absorbent (UV-3) | 0.19 |
| Dye Image Stabilizer (Cpd-1) | 0.24 |
| Dye Image Stabilizer (Cpd-6) | 0.01 |
| Dye Image Stabilizer (Cpd-8) | 0.01 |
| Dye Image Stabilizer (Cpd-9) | 0.04 |
| Dye Image Stabilizer (Cpd-10) | 0.01 |
| Solvent (Solv-1) | 0.01 |
| Solvent (Solv-6) | 0.21 |
| Sixth Layer (Ultraviolet Absorbing Layer) | |
| Gelatin | 0.64 |
| Ultraviolet Absorbent (UV-2) | 0.39 |

-continued

| | |
|---|---|
| Solvent (Solv-8) | 0.05 |
| Seventh Layer (Protective Layer) | |
| Gelatin | 1.01 |
| Acryl-modified copolymer of polyvinyl alcohol (modification degree: 17%) | 0.04 |
| Liquid paraffin | 0.02 |
| Surface Active Agent (Cpd-11) | 0.01 |

Yellow Coupler (ExY) was the same as the above-described Compound Y-4 and Magenta Coupler (ExM) was the same as the above-described Compound M-6.

Cyan Coupler (ExC)

A 25:75 (by mole) mixture of the above-described Compound C-2 and Compound C-5.

Dye Image Stabilizer (Cpd-1)

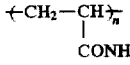

Number average molecular weight: 60,000

Dye Image Stabilizer (Cpd-2)

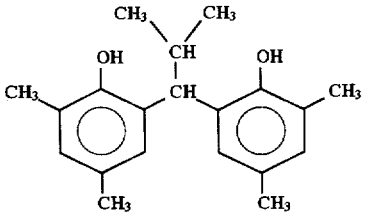

Dye Image Stabilizer (Cpd-3)

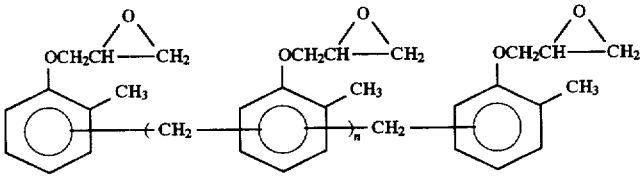

(n = 7 to 8 (on average))

Color Mixing Inhibitor (Cpd-4)

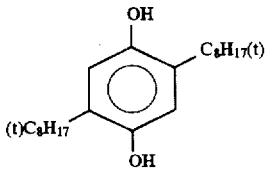

Dye Image Stabilizer (Cpd-5)

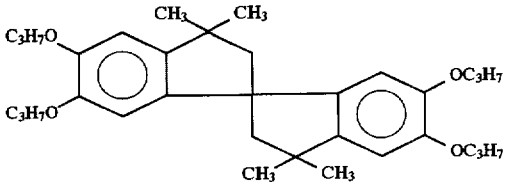

Dye Image Stabilizer (Cpd-6)

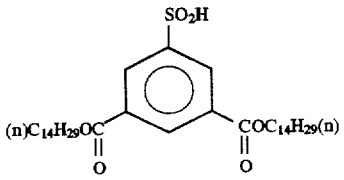

Color Image Stabilizer (Cpd-8)

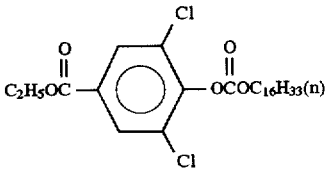

-continued
Dye Image Stabilizer (Cpd-9)
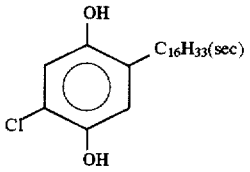
Dye Image Stabilizer (Cpd-10)
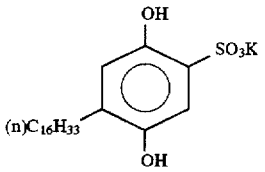
Surface Active Agent (Cpd-11)
A 7:3 (by weight) mixture of:
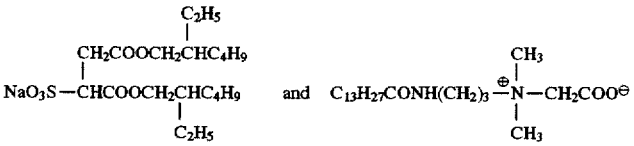
Antiseptic (Cpd-12)
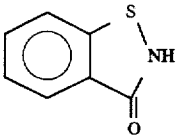
Antiseptic (Cpd-13)
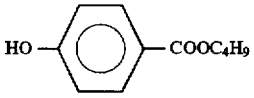
Antiseptic (Cpd-14)
A 1:1:1:1 mixture of a, b, c and d:
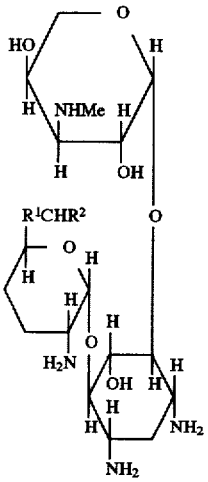
| | $R^1$ | $R^2$ |
|---|---|---|
| a | —Me | —NHMe |
| b | —Me | —$NH_2$ |
| c | —H | —$NH_2$ |
| d | —H | —NHMe |
Antispetic (Cpd-15)
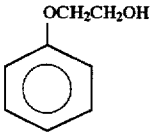
Ultraviolet Absorbent (UV-1)
A 1:3:4 (by weight) mixture of (1), (2) and (3):
(1)
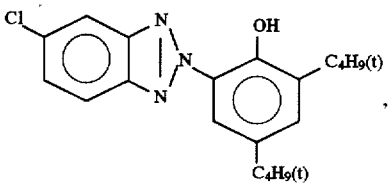
(2)
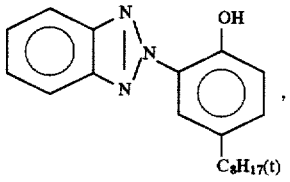
(3)
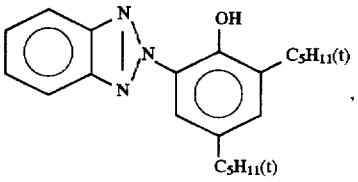

-continued
Ultraviolet Absorbent (UV-2)
A 1:2:2:3:1 (by weight) mixture of (1), (2) and (3), (4) and (5):
(1)
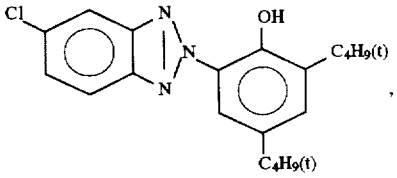
(2)
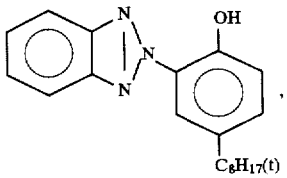
(3)
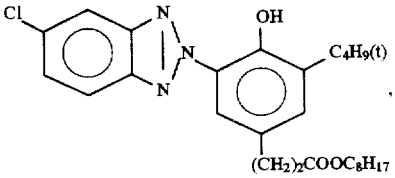
(4)
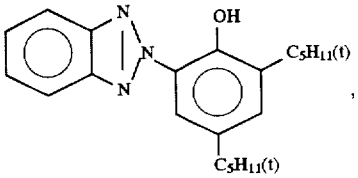
(5)
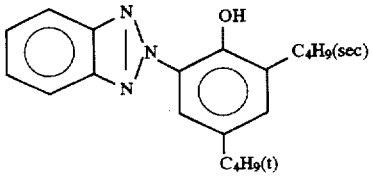
Ultraviolet Absorbent (UV-3)
A 1:3:2:1 (by weight) mixture of (1), (2), (3) and (4):
(1)
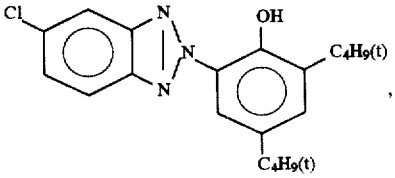
(2)
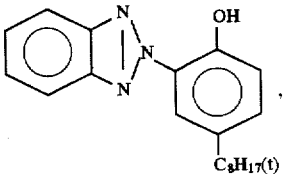
(3)
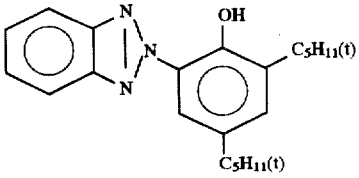
(4)
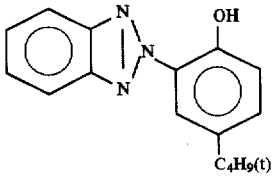
Solvent (Solv-1)
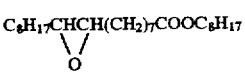
(Solvent (Solv-2)
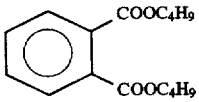
Solvent (Solv-3)
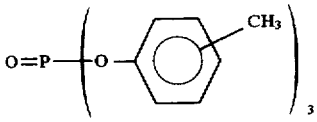
Solvent (Solv-4)
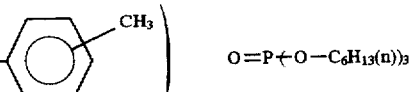

-continued

Solvent (Solv-5)

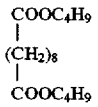

Solvent (Solv-6)

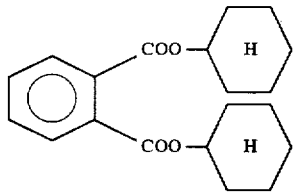

Solvent (Solv-7)

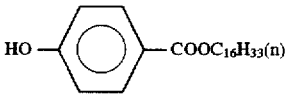

Solvent (Solv-8)

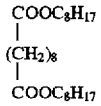

Sample K107 obtained was exposed using a sensitometry (Model FWH, manufactured by Fuji Photo Film Co., Ltd.; color temperature of the light source: 3,200° K.) so that about 35% of the silver coated was developed and gray color was provided.

Thereafter, Sample K107 was subjected to a continuous processing over 20 $m^2$ through the following processing steps and using the solutions each having the composition described below by means of a paper processor.

| Processing Step | Temperature (°C.) | Time (sec.) | Replenisher* (ml) | Tank Volume (l) |
|---|---|---|---|---|
| Color development | 35 | 45 | 161 | 10 |
| Bleach-fixing | 35 | 45 | 218 | 10 |
| Rinsing (1) | 35 | 30 | — | 5 |
| Rinsing (2) | 35 | 30 | — | 5 |
| Rinsing (3) | 35 | 30 | 360 | 5 |
| Drying | 80 | 60 | | |

*Replenishing amount was per 1 $m^2$ of the light-sensitive material.

(The rinsing was in a three-tank countercurrent system from Rinsing (3) to Rinsing (1).)

Each processing solution had the following composition.

Color Developer

| | Tank Solution | Replenisher |
|---|---|---|
| Water | 800 ml | 800 ml |
| Ethylenediaminetetraacetic acid | 3.0 g | 3.0 g |
| Disodium 4,5-dihydroxy-benzene-1,3-disulfonate | 0.5 g | 0.5 g |
| Triethanolamine | 12.0 g | 12.0 g |
| Potassium chloride | 2.5 g | — |
| Potassium bromide | 0.01 g | — |
| Potassium carbonate | 27.0 g | 27.0 g |
| Fluorescent brightening agent (WHITEX4, produced by Sumitomo Chemical Co., Ltd.) | 1.0 g | 2.5 g |
| Sodium sulfite | 0.1 g | 0.2 g |
| Disodium-N,N-bis(sulfnato-ethyl)hydroxylamine | 5.0 g | 8.0 g |
| N-Ethyl-N-(β-methanesulfon-amidoethyl)-3-methyl-4-amino-aniline·3/2 sulfate monohydrate | 5.0 g | 7.1 g |
| Water to make | 1,000 ml | 1,000 ml |
| pH (25° C., adjusted with potassium hydroxide and sulfuric acid) | 10.05 | 10.45 |

Bleach-Fixing Solution

The tank solution and the replenisher were the same.

| | |
|---|---|
| Water | 600 ml |
| Ammonium thiosulfate (700 g/liter) | 100 ml |
| Ammonium sulfite | 40 g |
| Ammonium ethylenediaminetetraacetato iron (III) | 55 g |
| Iron ethylenediaminetetraacetate | 5 g |
| Ammonium bromide | 40 g |
| Sulfuric acid (67%) | 30 g |
| Water to make | 1,000 ml |
| pH (25° C., adjusted with acetic acid and aqueous ammonia) | 5.8 |

Rinsing Solution

The tank solution and the replenisher were the same.

| | |
|---|---|
| Sodium chlorinated isocyanurate | 0.02 g |
| Deionized water (electro-conductivity: 5 μs/cm or less) | 1,000 ml |
| pH | 6.5 |

Multi-layer color photographic materials (Samples K101 to K120) were prepared thoroughly in the same manner as Sample 107 except for replacing the emulsified product in the sixth layer by the emulsified products (Samples 101 to 120) prepared in Example 1 so as to give the same coating amount as that of Compound UV-2 in the sixth layer of Sample K101, processed according to the above-described processing method and then measured on the yellow density of the white background. Thereafter, each photographic material was subjected to light irradiation using a xenon discoloration tester at 100,000 lux under the condition of 55% relative humidity for two weeks. The yellow density of the white background after light irradiation was measured and the increase in yellow stains was obtained. The results obtained are shown in Table G.

TABLE G

| | Emulsification | Surface Defect (Agglomerate) | Increase in Yellow Stains between Before and After Light Irradiation of Sample Coated by Emulsified Product Immediately After Emulsification | Increase in Yellow Stains between Before and After Light Irradiation Coated by Emulsified Product Aged After Emulsification at 4° C. for One Month | Remarks |
|---|---|---|---|---|---|
| K101 | A | Δ | +0.03 | 0.04 | Comparison |
| K102 | A | ○ | 0.02 | 0.03 | Invention |
| K103 | A | Δ | 0.03 | 0.04 | Comparison |
| K104 | A | ○ | 0.02 | 0.03 | Invention |
| K105 | A | x | 0.03 | 0.05 | Comparison |
| K106 | A | x | 0.02 | 0.04 | Comparison |
| K107 | A | Δ | 0.02 | 0.05 | Comparison |
| K108 | A | ○ | 0.02 | 0.03 | Invention |
| K109 | A | ○ | 0.02 | 0.03 | Invention |
| K110 | A | ○ | 0.03 | 0.03 | Invention |
| K111 | A | Δ | 0.03 | 0.03 | Invention |
| K112 | A | Δ | 0.03 | 0.04 | Comparison |
| K113 | A | x | 0.04 | 0.04 | Comparison |
| K114 | A | ○ | 0.02 | 0.02 | Invention |
| K115 | A | ○ | 0.03 | 0.03 | Invention |
| K116 | A | ○ | 0.03 | 0.03 | Invention |
| K117 | A | ○ | 0.03 | 0.05 | Comparison |
| K118 | A | x | 0.04 | 0.05 | Comparison |
| K119 | A | ○ | 0.03 | 0.05 | Comparison |
| K120 | A | x | 0.04 | 0.05 | Comparison |

○: The coated surface had disorders due to agglomerate at the frequency of from 0 to 1 per $dm^2$.
Δ: The coated surface had disorders due to agglomerate at the frequency of 2 or more per $dm^2$.
x: The disorder due to agglomerate was readily observed on the coated surface by the naked eye and the viewing of sample can hardly be endured.

As is seen from Table G, in multi-layer color light-sensitive materials using a polymer of the present invention, the defect on the surface due to coarse grains was small and yellowing of the white background at the light irradiation was low irrespective of whether the emulsified product was used before or after storage.

Further, multi-layer color photographic materials (Samples K121 to K141) were prepared thoroughly in the same manner as Sample 107 except for replacing the emulsified product in the third layer by the emulsified products (Samples 121 to 141) prepared in Example 2 so as to give the same coating amount as that of Compound ExM in the third layer of Sample K101, processed according to the above-described processing method and then measured on the maximum magenta density. The results obtained are shown in Table H.

TABLE H

| | Emulsification | Surface Defect (Agglomerate) | Maximum Magenta Density of Sample Coated by Emulsified Product Immediately After Emulsification | Maximum Magenta Density of Sample Coated by Emulsified Product Aged After Emulsification at 4° C. for One Month | Remarks |
|---|---|---|---|---|---|
| K121 | B | Δ | 2.06 | 2.04 | Comparison |
| K122 | B | ○ | 2.12 | 2.10 | Invention |
| K123 | B | Δ | 2.08 | 2.04 | Comparison |
| K124 | B | ○ | 2.12 | 2.09 | Invention |
| K125 | B | x | 2.07 | 2.03 | Comparison |
| K126 | B | x | 2.12 | 2.08 | Comparison |
| K127 | B | Δ | 2.12 | 2.04 | Comparison |
| K128 | B | ○ | 2.13 | 2.11 | Invention |
| K129 | B | ○ | 2.12 | 2.11 | Invention |
| K130 | B | ○ | 2.12 | 2.11 | Invention |
| K131 | B | ○ | 2.12 | 2.11 | Invention |
| K132 | B | Δ | 2.09 | 2.08 | Invention |
| K133 | B | x | 2.03 | 2.02 | Comparison |
| K134 | B | x | 2.01 | 1.99 | Comparison |
| K135 | B | ○ | 2.13 | 2.10 | Invention |
| K136 | B | ○ | 2.10 | 2.08 | Invention |
| K137 | B | ○ | 2.08 | 2.08 | Invention |
| K138 | B | ○ | 2.13 | 2.05 | Comparison |
| K139 | B | x | 2.01 | 1.94 | Comparison |
| K140 | B | ○ | 2.11 | 2.04 | Comparison |
| K141 | B | x | 2.04 | 2.00 | Comparison |

As is seen from Table H, in multi-layer color light-sensitive materials using a polymer of the present invention, the defect on the surface due to coarse grains was small and the maximum density of magenta coloring was high irrespective of whether the emulsified product was used before or after storage.

Then, Samples K101 to K141 were examined on the coated surface.

As is seen from Table G and Table H, the multi-layer coated samples using an emulsified product of the present invention had little defect on the coated surface due to coarse grains resulting from defective dissolution at the preparation of the emulsified dispersion or deposition during its storage and had good surface state. The surface defect in Tables G and H was evaluated by observing coated samples in a size of 10 cm×10 cm through a stereomicroscope at the magnification of 20 times. ○ is the case where no defect due to coarse grains was observed on the coated surface, Δ is the case where defects due to coarse grains were observed in some places on the coated surface and x is the case where defects due to coarse grains were readily observed on the coated surface even by the naked eye and viewing of the sample is on the level beyond endurance.

Multi-layer Color Photographic Light-sensitive Materials (Samples K149 to 162) were prepared in the same manner as in Example 2 except for replacing the emulsified product of the third layer in Example 2 by Emulsified Product Samples 149 to 162 each using a polymer set forth in Table I, exposed, developed so as to provide maximum yellow, magenta and cyan densities, superposed so that emulsion-coated surfaces faced with each other and stored at 80° C. and 70% RH for 4 days under pressure at a load of 3 kg/dm$^2$. The samples obtained above was aged at 25° C. and 55% RH for one day and then the superposed samples were peeled off at a peeling angle of 90°. Thereafter, the emulsion-coated surface was visually observed and examined whether peeling was generated in the second, third or fourth layer.

The results are shown in Table I.

TABLE I

| Sample No. | Structure of Polymer | Number Average Molecular Weight | Peeling in Second, Third or Fourth Layer | Remarks |
|---|---|---|---|---|
| K149 | P-15 | 300 | ◎ | Invention |
| K150 | " | 590 | ◎ | Invention |
| K151 | " | 900 | ◎ | Invention |
| K152 | " | 1,900 | ◎ | Invention |
| K153 | " | 3,900 | ○ | Invention |
| K154 | " | 8,000 | Δ | Comparison |
| K155 | " | 15,000 | x | Comparison |
| K156 | P-26 | 500 | ◎ | Invention |
| K157 | P-8 | 1,500 | ○ | Invention |
| K158 | P-23 | 1,000 | ◎ | Invention |
| K159 | R-2 | 600 | Δ | Comparison |
| K160 | " | 13,000 | Δ | Comparison |
| K161 | R-3 | 570 | x | Comparison |
| K162 | " | 13,000 | Δ | Comparison |

◎: The release was made throughout the entire surface of a photographic light-sensitive material.
○: The peeling occurred in the second, third or fourth layer by the area of 5% or less of the total sample surface.
Δ: The peeling occurred in the second, third or fourth layer by the area of from 6 to 25% of the total sample area.
x: The peeling occurred in the second, third or fourth layer by the area of from 26% or more of the total sample area.

As is seen in Table I, the polymers having the same repeating unit structure as that of the present invention but having a number average molecular weight of 8,000 or more readily caused peeling in the layer where the polymer was added or adjacent layers thereto at a high humidity, thus it is understood that the polymers of the present invention having a number average molecular weight of 4,000 or less were excellent causing little peeling in layers upon bonding of the emulsion surface and those having a number average molecular weight of 2,000 or less were yet superior. Also, it is seen that Comparative Samples K154, K155 and K159 to K162 underwent peeling in layers at a high humidity as compared with the embodiments of the present invention.

While the invention has been described in detail and with reference to specific embodiments thereof, it will be apparent to one skilled in the art that various changes and modifications can be made therein without departing from the spirit and scope thereof.

What is claimed is:

1. A silver halide photographic material comprising a support having thereon hydrophilic colloid layers with at least one layer thereof containing at least one water-insoluble polymer which is a polymer containing an aromatic ring and having a backbone chain and a number average molecular weight of 4,000 or less, wherein the weight percentage of the aromatic ring in a molecule of the polymer is 40% or more based on the weight of the polymer molecule, and wherein the aromatic ring is in the backbone chain or at a side position with respect to the backbone chain in the polymer.

2. A silver halide photographic material as claimed in claim 1, wherein said aromatic ring contained in the water-insoluble polymer comprises a benzene ring, a naphthalene ring, an anthrathene ring, an indene ring or an aromatic heterocyclic ring.

3. A silver halide photographic material as claimed in claim 1, wherein said water-insoluble polymer having a number average molecular weight of 4,000 or less is a homopolymer or a copolymer derived from at least one of styrene, α-methylstyrene, β-methylstyrene and a monomer unit having a substituent on the benzene ring of these monomers.

4. A silver halide photographic material as claimed in claim 3, wherein styrene, α-methylstyrene and β- methylstyrene each are unsubstituted.

5. A silver halide photographic material as claimed in claim 3, wherein styrene, α-methylstyrene and β-methylstyrene each have a substituent on the benzene ring thereof, which is selected from the group consisting of an alkyl group, an alkoxy group, and a halogen atom.

6. A silver halide photographic material as claimed in claim 5, wherein the halogen is selected from the group consisting of fluorine and chlorine, the alkyl group is selected from the group consisting of methyl, ethyl, i-propyl, and t-propyl, and the alkoxy group is methoxy.

7. A silver halide photographic material as claimed in claim 1, wherein the weight percentage of the aromatic ring in the molecule of said water-insoluble polymer having a number average molecular weight of 4,000 or less is 50% or more.

8. A silver halide photographic material as claimed in claim 1, wherein the weight percentage of the aromatic ring in the molecule of said water-insoluble polymer having a number average molecular weight of 4,000 or less is 55% or more.

9. A silver halide photographic material as claimed in claim 1, wherein said water-insoluble polymer is a polymer having a number average molecular weight of 1,500 or less.

10. A silver halide photographic material as claimed in claim 1, wherein said water-insoluble polymer is added to a layer containing lipophilic components, wherein said water-insoluble polymer is used in an amount of from 0.01 to 0.7 parts by weight of the lipophilic components.

11. A silver halide photographic material as claimed in claim 1, wherein said support is a reflection support.

* * * * *